US008174475B2

(12) United States Patent
Nishimura et al.

(10) Patent No.: US 8,174,475 B2
(45) Date of Patent: May 8, 2012

(54) D/A CONVERSION CIRCUIT, DATA DRIVER, INTEGRATED CIRCUIT DEVICE, AND ELECTRONIC INSTRUMENT

(75) Inventors: Motoaki Nishimura, Fujimi-machi (JP); Haruo Kamijo, Shiojiri (JP); Katsuhiko Maki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 875 days.

(21) Appl. No.: 12/251,865

(22) Filed: Oct. 15, 2008

(65) Prior Publication Data

US 2009/0096817 A1 Apr. 16, 2009

(30) Foreign Application Priority Data

Oct. 16, 2007 (JP) ..... 2007-268761
May 23, 2008 (JP) ..... 2008-135536

(51) Int. Cl.
*G09G 3/36* (2006.01)

(52) U.S. Cl. ..... 345/98; 345/99; 345/100; 341/144

(58) Field of Classification Search ..... 345/98–100, 345/690; 341/144
See application file for complete search history.

(56) References Cited

U.S. PATENT DOCUMENTS 6,304,241 B1 * 10/2001 Udo et al. ..... 345/96
2006/0145905 A1 * 7/2006 Fackenthal et al. ..... 341/144
2007/0069935 A1 * 3/2007 Ko ..... 341/144
2008/0048935 A1 * 2/2008 Yoshioka et al. ..... 345/55
2008/0079618 A1 * 4/2008 Hino ..... 341/144

FOREIGN PATENT DOCUMENTS

JP A-2001-318652 11/2001
JP A-2005-175811 6/2005
JP A-2005-175812 6/2005

OTHER PUBLICATIONS

U.S. Appl. No. 12/251,907, filed Oct. 15, 2008 in the name of Motoaki Nishimura et al.
U.S. Appl. No. 12/251,776, filed Oct. 15, 2008 in the name of Haruo Kamijo et al.

* cited by examiner

*Primary Examiner* — Richard Hjerpe
*Assistant Examiner* — Sahlu Okebato
(74) *Attorney, Agent, or Firm* — Oliff & Berridge, PLC

(57) ABSTRACT

A D/A conversion circuit includes a first D/A converter and a second D/A converter that respectively output a first voltage and a second voltage. An ith two-input selector among a plurality of input selectors of the first D/A converter selects a (4i+1)th input voltage or a (4i+3)th input voltage based on input data, and outputs the selected input voltage to a selector of a selector block in the subsequent stage. An ith three-input selector among a plurality of three-input selectors of the second D/A converter selects a 4ith input voltage, a (4i+2)th input voltage, or a (4i+4)th input voltage based on the input data, and outputs the selected input voltage to a selector of a selector block in the subsequent stage.

17 Claims, 25 Drawing Sheets

FIG. 5

| GRAYSCALE DATA | | | | | | | SELECTED GRAYSCALE VOLTAGE | | THIRD STAGE (BL3A, BL3B) | | | | SECOND STAGE (BL2A, BL2B) | | | | FIRST STAGE (BL1A, BL1B) | | | |
|---|---|---|---|---|---|---|---|---|---|---|---|---|---|---|---|---|---|---|---|---|
| DEC | BIN | | | | | | DACA (VG1) | DACB (VG2) | DACA AND DACB | | | | DACA AND DACB | | | | DACA | DACB | | |
| | D7 | D6 | D5 | D4 | D3 | D2 | | | EN3[3] | EN3[2] | EN3[1] | EN3[0] | EN2[3] | EN2[2] | EN2[1] | EN2[0] | EN1A | EN1B[2] | EN1B[1] | EN1B[0] |
| 0 | 0 | 0 | 0 | 0 | 0 | 0 | V | 0 | 0 | 0 | 0 | 1 | 0 | 0 | 0 | 1 | 1 | 0 | 0 | 1 |
| 1 | 0 | 0 | 0 | 0 | 0 | 1 | V | 2V | 0 | 0 | 0 | 1 | 0 | 0 | 0 | 1 | 1 | 0 | 1 | 0 |
| 2 | 0 | 0 | 0 | 0 | 1 | 0 | 3V | 2V | 0 | 0 | 0 | 1 | 0 | 0 | 0 | 1 | 0 | 0 | 1 | 0 |
| 3 | 0 | 0 | 0 | 0 | 1 | 1 | 3V | 4V | 0 | 0 | 0 | 1 | 0 | 0 | 0 | 1 | 0 | 1 | 0 | 0 |
| 4 | 0 | 0 | 0 | 1 | 0 | 0 | 5V | 4V | 0 | 0 | 0 | 1 | 0 | 0 | 1 | 0 | 1 | 0 | 0 | 1 |
| 5 | 0 | 0 | 0 | 1 | 0 | 1 | 5V | 6V | 0 | 0 | 0 | 1 | 0 | 0 | 1 | 0 | 1 | 0 | 1 | 0 |
| 6 | 0 | 0 | 0 | 1 | 1 | 0 | 7V | 6V | 0 | 0 | 0 | 1 | 0 | 0 | 1 | 0 | 0 | 0 | 1 | 0 |
| 7 | 0 | 0 | 0 | 1 | 1 | 1 | 7V | 8V | 0 | 0 | 0 | 1 | 0 | 0 | 1 | 0 | 0 | 1 | 0 | 0 |
| 8 | 0 | 0 | 1 | 0 | 0 | 0 | 9V | 8V | 0 | 0 | 0 | 1 | 0 | 1 | 0 | 0 | 1 | 0 | 0 | 1 |
| 9 | 0 | 0 | 1 | 0 | 0 | 1 | 9V | 10V | 0 | 0 | 0 | 1 | 0 | 1 | 0 | 0 | 1 | 0 | 1 | 0 |
| 10 | 0 | 0 | 1 | 0 | 1 | 0 | 11V | 10V | 0 | 0 | 0 | 1 | 0 | 1 | 0 | 0 | 0 | 0 | 1 | 0 |
| 11 | 0 | 0 | 1 | 0 | 1 | 1 | 11V | 12V | 0 | 0 | 0 | 1 | 0 | 1 | 0 | 0 | 0 | 1 | 0 | 0 |
| 12 | 0 | 0 | 1 | 1 | 0 | 0 | 13V | 12V | 0 | 0 | 0 | 1 | 1 | 0 | 0 | 0 | 1 | 0 | 0 | 1 |
| 13 | 0 | 0 | 1 | 1 | 0 | 1 | 13V | 14V | 0 | 0 | 0 | 1 | 1 | 0 | 0 | 0 | 1 | 0 | 1 | 0 |
| 14 | 0 | 0 | 1 | 1 | 1 | 0 | 15V | 14V | 0 | 0 | 0 | 1 | 1 | 0 | 0 | 0 | 0 | 0 | 1 | 0 |
| 15 | 0 | 0 | 1 | 1 | 1 | 1 | 15V | 16V | 0 | 0 | 0 | 1 | 1 | 0 | 0 | 0 | 0 | 1 | 0 | 0 |
| 16 | 0 | 1 | 0 | 0 | 0 | 0 | 17V | 16V | 0 | 0 | 1 | 0 | 0 | 0 | 0 | 1 | 1 | 0 | 0 | 1 |
| 17 | 0 | 1 | 0 | 0 | 0 | 1 | 17V | 18V | 0 | 0 | 1 | 0 | 0 | 0 | 0 | 1 | 1 | 0 | 1 | 0 |
| 18 | 0 | 1 | 0 | 0 | 1 | 0 | 19V | 18V | 0 | 0 | 1 | 0 | 0 | 0 | 0 | 1 | 0 | 0 | 1 | 0 |
| 19 | 0 | 1 | 0 | 0 | 1 | 1 | 19V | 20V | 0 | 0 | 1 | 0 | 0 | 0 | 0 | 1 | 0 | 1 | 0 | 0 |

FIG. 9

| GRAYSCALE DATA DG | | | | | | | | VG1 | VG2 | SW1 | SW2 | SW3 | SW4 | VI1 | VI2 | VS |
|---|---|---|---|---|---|---|---|---|---|---|---|---|---|---|---|---|
| D7 | D6 | D5 | D4 | D3 | D2 | D1 | D0 | | | | | | | | | |
| 0 | 0 | 0 | 0 | 0 | 0 | 0 | 0 | V1 | V0 | × (OFF) | ○ (ON) | × (OFF) | ○ (ON) | V0 (VG2) | V0 (VG2) | V0 |
| 0 | 0 | 0 | 0 | 0 | 0 | 0 | 1 | V1 | V0 | ○ | × | × | ○ | V1 (VG1) | V0 (VG2) | $V0-\frac{V0-V1}{2}$ |
| 0 | 0 | 0 | 0 | 0 | 0 | 1 | 0 | V1 | V2 | ○ | × | ○ | × | V1 (VG1) | V1 (VG1) | V1 |
| 0 | 0 | 0 | 0 | 0 | 0 | 1 | 1 | V1 | V2 | × | ○ | ○ | × | V2 (VG2) | V1 (VG1) | $V1-\frac{V1-V2}{2}$ |
| 0 | 0 | 0 | 0 | 0 | 1 | 0 | 0 | V3 | V2 | × | ○ | × | ○ | V2 (VG2) | V2 (VG2) | V2 |
| 0 | 0 | 0 | 0 | 0 | 1 | 0 | 1 | V3 | V2 | ○ | × | × | ○ | V3 (VG1) | V2 (VG2) | $V2-\frac{V2-V3}{2}$ |
| 0 | 0 | 0 | 0 | 0 | 1 | 1 | 0 | V3 | V4 | ○ | × | ○ | × | V3 (VG1) | V3 (VG1) | V3 |
| 0 | 0 | 0 | 0 | 0 | 1 | 1 | 1 | V3 | V4 | × | ○ | ○ | × | V4 (VG2) | V3 (VG1) | $V3-\frac{V3-V4}{2}$ |

FIG. 10A SAMPLING PERIOD
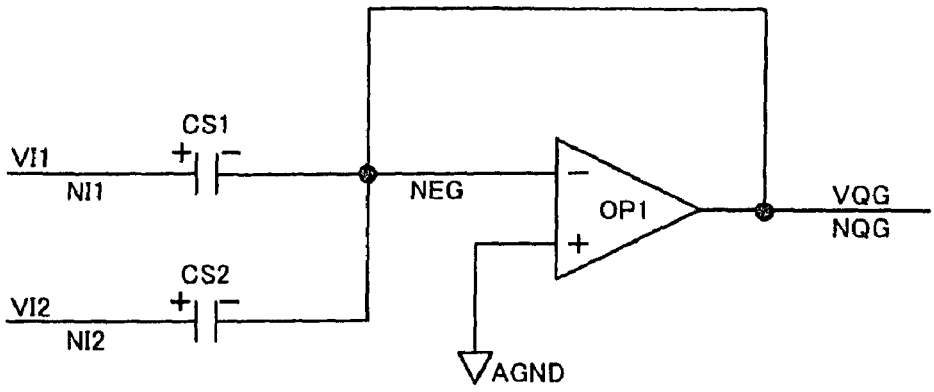
FIG. 10B HOLDING PERIOD
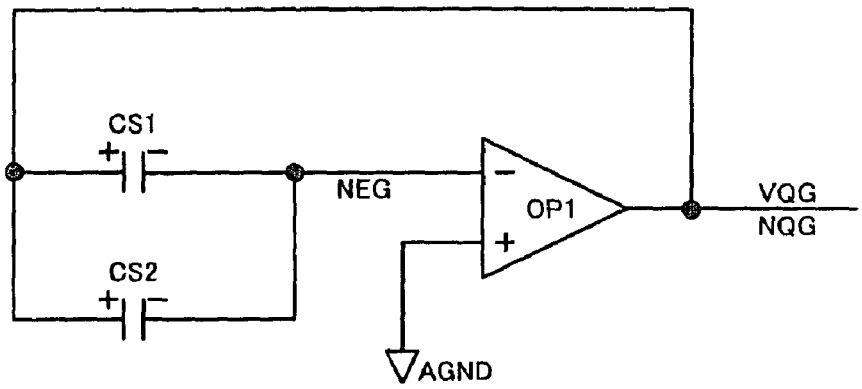

FIG. 11A SAMPLING PERIOD
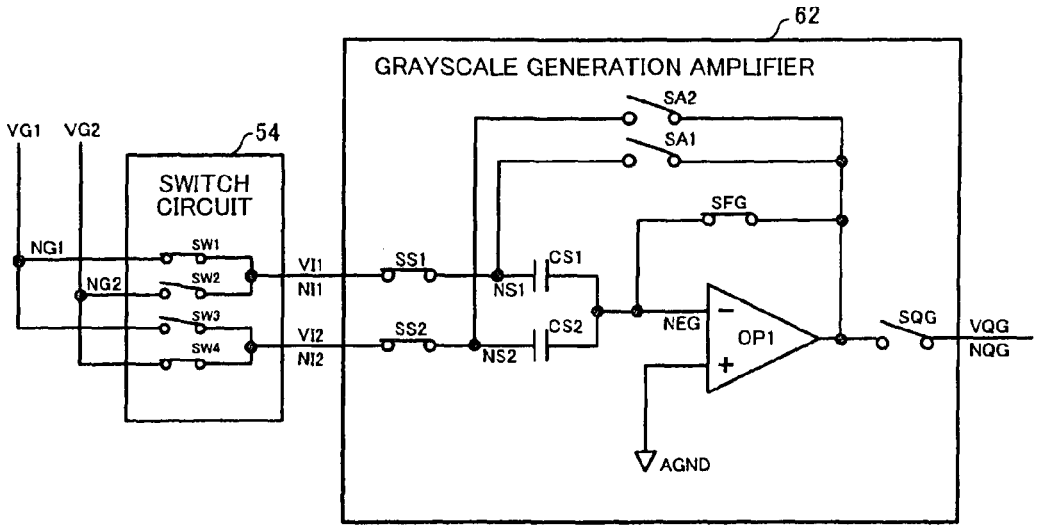
FIG. 11B HOLDING PERIOD
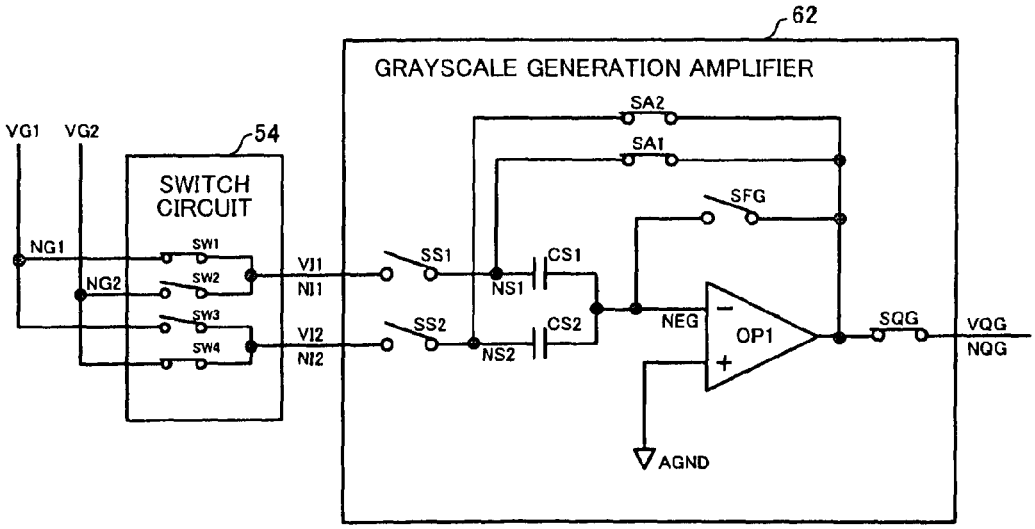

FIG. 13A SAMPLING PERIOD
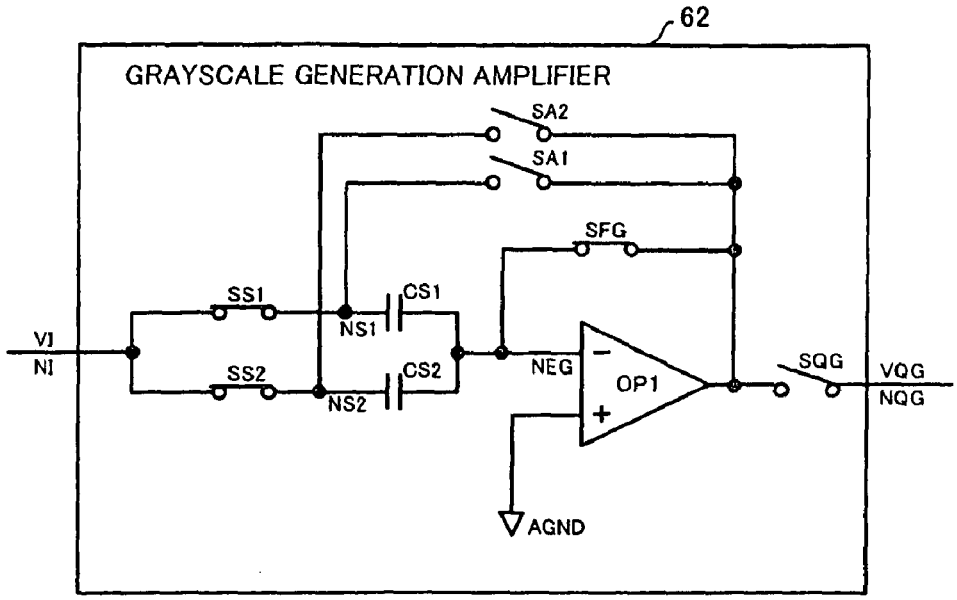
FIG. 13B HOLDING PERIOD
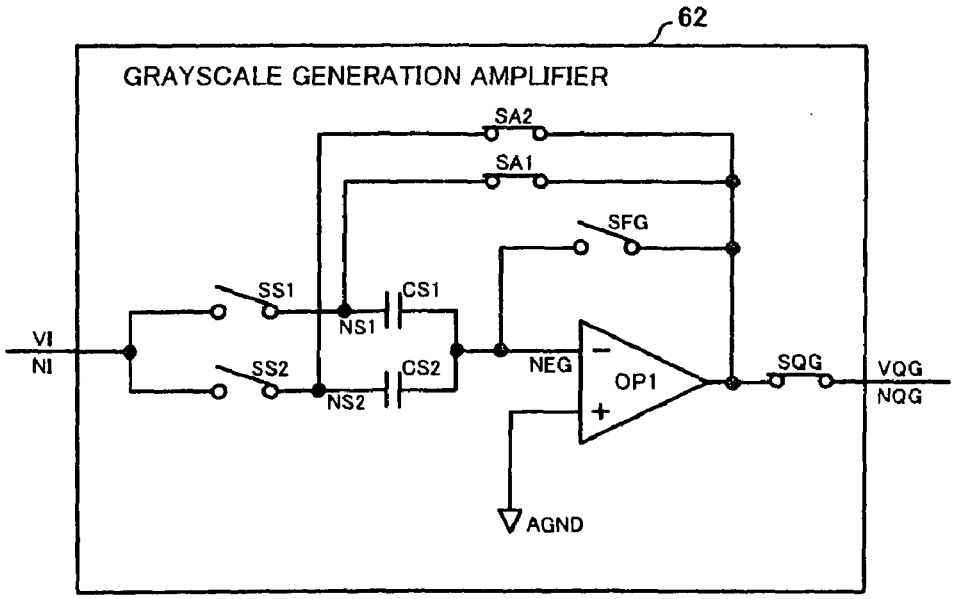

FIG. 23

| D2 | D1 | D0 | SW1 | SW2 | SW3 | SW4 | SW5 | SW6 | SW7 | SW8 | VI1 | VI2 | VI3 | VI4 | RELATION-SHIP |
|---|---|---|---|---|---|---|---|---|---|---|---|---|---|---|---|
| 0 | 0 | 0 | × (OFF) | ○ (ON) | × (OFF) | ○ (ON) | × (OFF) | ○ (ON) | × (OFF) | ○ (ON) | VG2 | VG2 | VG2 | VG2 | VG1>VG2 |
| 0 | 0 | 1 | ○ | × | × | ○ | × | ○ | × | ○ | VG1 | VG2 | VG2 | VG2 | |
| 0 | 1 | 0 | ○ | × | ○ | × | × | ○ | × | ○ | VG1 | VG1 | VG2 | VG2 | |
| 0 | 1 | 1 | ○ | × | ○ | × | ○ | × | × | ○ | VG1 | VG1 | VG1 | VG2 | |
| 1 | 0 | 0 | ○ | × | ○ | × | ○ | × | ○ | × | VG1 | VG1 | VG1 | VG1 | VG1<VG2 |
| 1 | 0 | 1 | × | ○ | ○ | × | ○ | × | ○ | × | VG2 | VG1 | VG1 | VG1 | |
| 1 | 1 | 0 | × | ○ | × | ○ | ○ | × | ○ | × | VG2 | VG2 | VG1 | VG1 | |
| 1 | 1 | 1 | × | ○ | × | ○ | × | ○ | ○ | × | VG2 | VG2 | VG2 | VG1 | |

FIG. 24

| D2 | D1 | D0 | VI1 | VI2 | VI3 | VI4 | VS | RELATION-SHIP |
|---|---|---|---|---|---|---|---|---|
| 0 | 0 | 0 | 0.0V | 0.0V | 0.0V | 0.0V | 0.0V | VG1=0.2V VG2=0.0V (VG1>VG2) |
| 0 | 0 | 1 | 0.2V | 0.0V | 0.0V | 0.0V | 0.05V | |
| 0 | 1 | 0 | 0.2V | 0.2V | 0.0V | 0.0V | 0.10V | |
| 0 | 1 | 1 | 0.2V | 0.2V | 0.2V | 0.0V | 0.15V | |
| 1 | 0 | 0 | 0.2V | 0.2V | 0.2V | 0.2V | 0.20V | VG1=0.2V VG2=0.4V (VG1<VG2) |
| 1 | 0 | 1 | 0.4V | 0.2V | 0.2V | 0.2V | 0.25V | |
| 1 | 1 | 0 | 0.4V | 0.4V | 0.2V | 0.2V | 0.30V | |
| 1 | 1 | 1 | 0.4V | 0.4V | 0.4V | 0.2V | 0.35V | |

D/A CONVERSION CIRCUIT, DATA DRIVER, INTEGRATED CIRCUIT DEVICE, AND ELECTRONIC INSTRUMENT

Japanese Patent Application No. 2007-268761 filed on Oct. 16, 2007 and Japanese Patent Application No. 2008-135536 filed on May 23, 2008, are hereby incorporated by reference in their entirety.

BACKGROUND

The present invention relates to a D/A conversion circuit, a data driver, an integrated circuit device, an electronic instrument, and the like.

As a liquid crystal panel (electro-optical device or display panel) used for electronic instruments such as portable telephones, a simple matrix liquid crystal panel and an active matrix liquid crystal panel that utilizes a switch element such as a thin film transistor have been known.

As disclosed in JP-A-2005-175811 and JP-A-2005-175812, a data driver (source driver) that drives data lines (source lines) of such a liquid crystal panel includes a D/A conversion circuit that outputs a grayscale voltage corresponding to grayscale data.

However, the circuit scale of the D/A conversion circuit increases as the number of bits of grayscale data increases due to an increase in the number of grayscales desired for a display panel.

An increase in display image quality has been desired for a liquid crystal panel. On the other hand, a reduction in power consumption and chip size has been desired for a data driver that drives a liquid crystal panel.

For example, JP-A-2005-175811 and JP-A-2005-175812 disclose a configuration that enables a Rail-to-Rail operation of an output circuit of a data driver that drives a data line while supplying a voltage to the data line with high accuracy.

According to the technologies disclosed in JP-A-2005-175811 and JP-A-2005-175812, the Rail-to-Rail operation is implemented by controlling the drive capability by providing an auxiliary circuit in each output circuit. Therefore, the circuit scale of the data driver increases due to the addition of the auxiliary circuit. Moreover, the transistor size must be increased in order to suppress a variation in voltage applied to the data line.

In order to supply an accurate voltage to the data line, a voltage output from a D/A conversion circuit that generates a grayscale voltage corresponding to grayscale data must be supplied directly to the data line. Therefore, it is necessary to increase the number of grayscale voltage lines as the number of grayscales increases, whereby the chip size increases.

An operational amplifier must be normally designed taking a variation in output voltage into consideration. Therefore, it is necessary to suppress a variation in output voltage by increasing the size of a transistor that forms an operational amplifier.

SUMMARY

According to one aspect of the invention, there is provided a D/A conversion circuit comprising:

a first D/A converter that selects a voltage corresponding to input data from a plurality of input voltages and outputs the selected voltage as a first voltage; and a second D/A converter that selects a voltage corresponding to the input data from a plurality of input voltages and outputs the selected voltage as a second voltage, each of the first D/A converter and the second D/A converter including multiple-stage selector blocks, an output from a selector included in a preceding-stage selector block among the multiple-stage selector blocks being input to a selector included in a subsequent-stage selector block among the multiple-stage selector blocks;

a first-stage selector block included in the multiple-stage selector blocks of the first D/A converter including a plurality of two-input selectors;

a first-stage selector block included in the multiple-stage selector blocks of the second D/A converter including a plurality of three-input selectors;

an ith two-input selector (i is an integer equal to or larger than zero) among the plurality of two-input selectors of the first D/A converter selecting a (4i+1)th input voltage or a (4i+3)th input voltage among the plurality of input voltages based on the input data, and outputting the selected input voltage to the selector of the selector block in the subsequent stage; and an ith three-input selector among the plurality of three-input selectors of the second D/A converter selecting a 4ith input voltage, a (4i+2)th input voltage, or a (4i+4)th input voltage among the plurality of input voltages based on the input data, and outputting the selected input voltage to the selector of the selector block in the subsequent stage.

According to another aspect of the invention, there is provided a data driver that drives a data line of an electro-optical device, the data driver comprising:

the above D/A conversion circuit that receives the grayscale data and outputs the first grayscale voltage and the second grayscale voltage corresponding to the grayscale data; and a data line driver circuit that includes a grayscale generation amplifier that generates a grayscale voltage between the first grayscale voltage and the second grayscale voltage.

According to another aspect of the invention, there is provided an integrated circuit device comprising the above data driver.

According to another aspect of the invention, there is provided an electronic instrument comprising the above integrated circuit device.

BRIEF DESCRIPTION OF THE DRAWINGS

FIG. 5 is a view showing the relationship among grayscale data, grayscale voltages selected by a first D/A converter and a second D/A converter, and selector control signals.

FIG. 9 is a view illustrative of the operations of a D/A conversion circuit, a switch circuit, and a grayscale generation amplifier.

FIGS. 10A and 10B are views illustrative of a flip-around sample-hold circuit.

FIGS. 11A and 11B show a configuration example of a grayscale generation amplifier using a flip-around sample-hold circuit.

FIGS. 13A and 13B show a second configuration example of a grayscale generation amplifier.

FIG. 23 is a view showing the relationship among grayscale data, the ON/OFF states of switch elements, and input voltages.

FIG. 24 is a view illustrative of a monotonic increase in output voltage of a grayscale generation amplifier.

DESCRIPTION OF EXEMPLARY EMBODIMENTS

Figure 1:
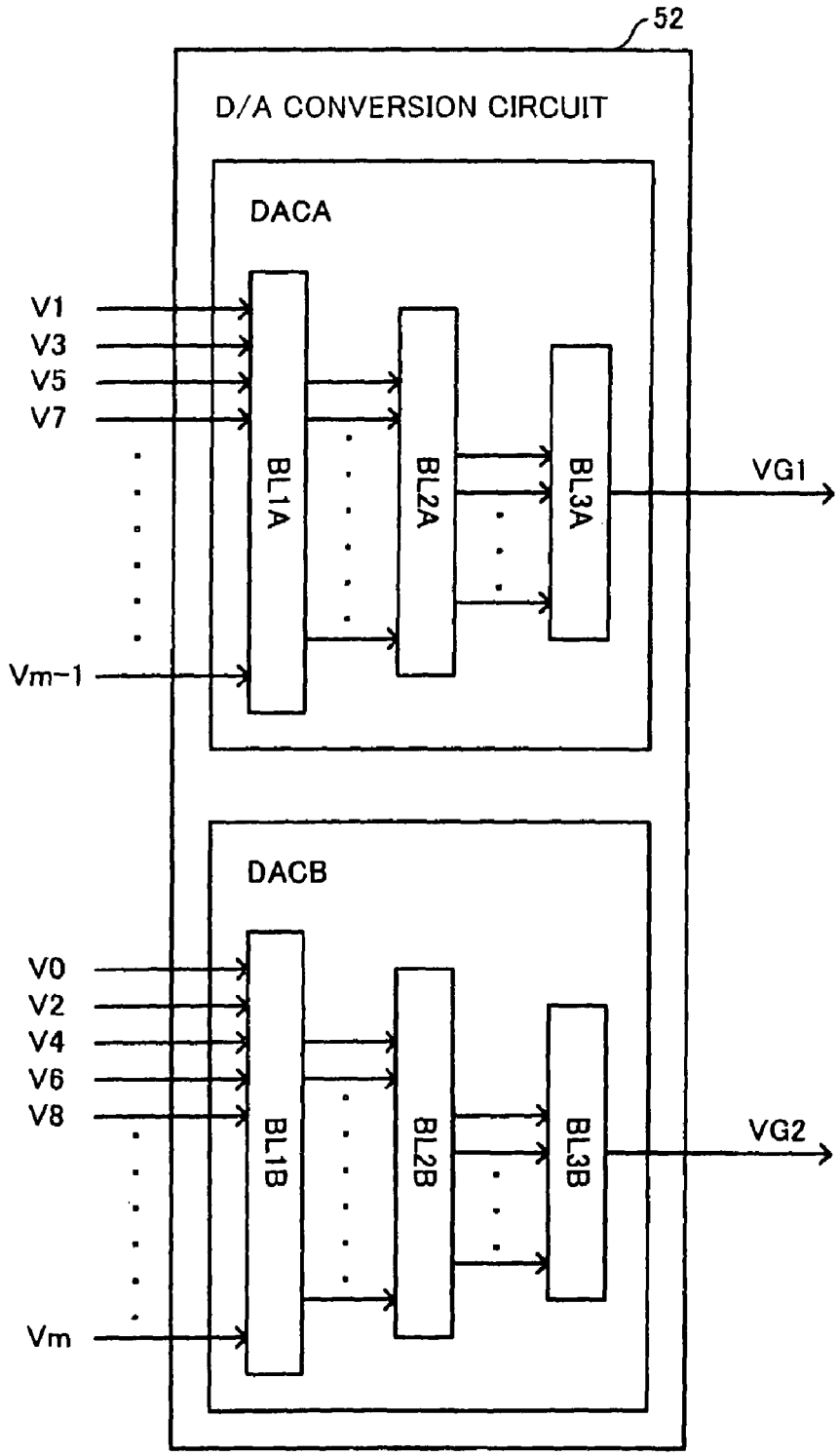
FIG. 1 shows a configuration example of a D/A conversion circuit according to one embodiment of the invention.

Several aspects of the invention may provide a D/A conversion circuit, a data driver, an integrated circuit device, and an electronic instrument that can output a first voltage and a second voltage corresponding to input data by a small circuit configuration.

Further aspects of the invention may provide a data driver, an integrated circuit device, and an electronic instrument that can supply a voltage to a data line by a small circuit configuration even when the number of grayscales increases.

According to one embodiment of the invention, there is provided a D/A conversion circuit comprising:

a first D/A converter that selects a voltage corresponding to input data from a plurality of input voltages and outputs the selected voltage as a first voltage; and a second D/A converter that selects a voltage corresponding to the input data from a plurality of input voltages and outputs the selected voltage as a second voltage, each of the first D/A converter and the second D/A converter including multiple-stage selector blocks, an output from a selector included in a preceding-stage selector block among the multiple-stage selector blocks being input to a selector included in a subsequent-stage selector block among the multiple-stage selector blocks;

a first-stage selector block included in the multiple-stage selector blocks of the first D/A converter including a plurality of two-input selectors;

a first-stage selector block included in the multiple-stage selector blocks of the second D/A converter including a plurality of three-input selectors;

an ith two-input selector (i is an integer equal to or larger than zero) among the plurality of two-input selectors of the first D/A converter selecting a (4i+1)th input voltage or a (4i+3)th input voltage among the plurality of input voltages based on the input data, and outputting the selected input voltage to the selector of the selector block in the subsequent stage; and an ith three-input selector among the plurality of three-input selectors of the second D/A converter selecting a 4ith input voltage, a (4i+2)th input voltage, or a (4i+4)th input voltage among the plurality of input voltages based on the input data, and outputting the selected input voltage to the selector of the selector block in the subsequent stage.

According to this embodiment, the D/A conversion circuit includes the first D/A converter and the second D/A converter that respectively output the first voltage and the second voltage corresponding to the input data. The ith two-input selector among the plurality of input selectors of the first D/A converter selects and outputs the (4i+1)th input voltage or the (4i+3)th input voltage based on the input data. The ith three-input selector among the plurality of three-input selectors of the second D/A converter selects and outputs the 4ith input voltage, the (4i+2)th input voltage, or the (4i+4)th input voltage based on the input data. According to this configuration, the first voltage and the second voltage corresponding to the input data can be output without providing a first D/A converter and a second D/A converter having an identical configuration. Therefore, the circuit area of the D/A conversion circuit can be reduced as compared with the case of providing a first D/A converter and a second D/A converter having an identical configuration so that a D/A conversion circuit that can output the first voltage and the second voltage corresponding to the input data by a small circuit configuration can be provided.

In the D/A conversion circuit, selectors included in the second-stage or subsequent-stage selector blocks of the first D/A converter and selectors included in the second-stage or subsequent-stage selector blocks of the second D/A converter may be controlled based on common selector control signals.

This makes it possible to provide a reduced number of selector control signal lines so that the wiring area can be reduced.

In the D/A conversion circuit, the ith two-input selector may select and output the (4i+1)th input voltage or the (4i+3)th input voltage based on a j+1)th bit (i is a natural number) of the input data; and the ith three-input selector may select and output the 4ith input voltage, the (4i+2)th input voltage, or the (4i+4)th input voltage based on the (+1)th bit and a jth bit of the input data.

According to this configuration, since the ith two-input selector of the first D/A converter is controlled based on the (j+1)th bit of the input data and the ith three-input selector of the second D/A converter is controlled based on the (j+1)th bit and the jth bit of the input data, selector control can be simplified.

In the D/A conversion circuit, the input data may be grayscale data; and the first voltage and the second voltage may be a first grayscale voltage and a second grayscale voltage corresponding to the grayscale data, respectively.

According to this configuration, a D/A conversion circuit that can output the first grayscale voltage and the second grayscale voltage corresponding to the grayscale data by a small circuit configuration can be provided.

According to another embodiment of the invention, there is provided a data driver that drives a data line of an electro-optical device, the data driver comprising:

the above D/A conversion circuit that receives the grayscale data and outputs the first grayscale voltage and the second grayscale voltage corresponding to the grayscale data; and a data line driver circuit that includes a grayscale generation amplifier that generates a grayscale voltage between the first grayscale voltage and the second grayscale voltage.

According to this configuration, a data driver that can reduce the number of grayscale voltages generated by the D/A conversion circuit and supply a voltage to the data line by a small circuit configuration can be implemented.

In the data driver, the grayscale generation amplifier may be formed by a flip-around sample-hold circuit.

Since the grayscale generation amplifier can be provided with a voltage sample-hold function and an offset-free state can be implemented by utilizing the flip-around sample-hold circuit, a highly accurate voltage that varies to only a small extent can be supplied to the data line.

In the data driver, the grayscale generation amplifier may include:

an operational amplifier;

a first sampling capacitor that is provided between a first input terminal of the operational amplifier and a first input node of the grayscale generation amplifier and stores a charge corresponding to an input voltage at the first input node in a sampling period; and a second sampling capacitor that is provided between the first input terminal of the operational amplifier and a second input node of the grayscale generation amplifier and stores a charge corresponding to an input voltage at the second input node in the sampling period, the grayscale generation amplifier may output an output voltage in a holding period, the output voltage corresponding to charges stored in the first sampling capacitor and the second sampling capacitor in the sampling period.

According to this configuration, the voltages input to the first input node and the second input node can be sampled into the first sampling capacitor and the second sampling capacitor in the sampling period, and the output voltage corresponding to charges stored in the first sampling capacitor and the second sampling capacitor can be output in the holding period by performing the flip-around operation of the first sampling capacitor and the second sampling capacitor.

In the data driver, the grayscale generation amplifier may include:

an operational amplifier, a second input terminal of the operational amplifier being set at a given reference voltage;

a first sampling switch element and a first sampling capacitor, the first sampling switch element and the first sampling capacitor being provided between a first input node of the grayscale generation amplifier and a first input terminal of the operational amplifier;

a second sampling switch element and a second sampling capacitor, the second sampling switch element and the second sampling capacitor being provided between a second input node of the grayscale generation amplifier and the first input terminal of the operational amplifier;

a feedback switch element provided between an output terminal of the operational amplifier and the first input terminal of the operational amplifier;

a first flip-around switch element provided between a first connection node and the output terminal of the operational amplifier, the first connection node being situated between the first sampling switch element and the first sampling capacitor; and a second flip-around switch element provided between a second connection node and the output terminal of the operational amplifier, the second connection node being situated between the second sampling switch element and the second sampling capacitor.

According to this configuration, the input voltages can be sampled into the first sampling capacitor and the second sampling capacitor using the first sampling switch element, the second sampling switch element, and the feedback switch element, and the flip-around operation of the first sampling capacitor and the second sampling capacitor can be implemented using the first flip-around switch element and the second flip-around switch element.

In the data driver, the first sampling switch element, the second sampling switch element, and the feedback switch element may be turned ON and the first flip-around switch element and the second flip-around switch element may be turned OFF in a sampling period; and the first sampling switch element, the second sampling switch element, and the feedback switch element may be turned OFF and the first flip-around switch element and the second flip-around switch element may be turned ON in a holding period.

Since the first sampling switch element, the second sampling switch element, and the feedback switch element are turned ON in the sampling period, charges corresponding to the input voltage can be stored in the first sampling capacitor and the second sampling capacitor utilizing the virtual short-circuit function of the operational amplifier. Since the first flip-around switch element and the second flip-around switch element are turned ON in the holding period, an output voltage corresponding to charges stored in the first sampling capacitor and the second sampling capacitor can be output to the output node of the grayscale generation amplifier.

In the data driver, the grayscale generation amplifier may include an output switch element provided between the output terminal of the operational amplifier and an output node of the grayscale generation amplifier;

the output switch element may be turned OFF in the sampling period; and the output switch element may be turned ON in the holding period.

Since the output switch element is turned OFF in the sampling period, a situation in which an indefinite voltage in the sampling period is transmitted to the subsequent stage can be prevented.

In the data driver, the first sampling switch element and the second sampling switch element may be turned OFF after the feedback switch element has been turned OFF.

This minimizes an adverse effect of charge injection via the first sampling switch element, the second sampling switch element, and the like.

In the data driver, the data line driver circuit may include a driver amplifier provided in the subsequent stage of the grayscale generation amplifier.

Since the data line drive time can be increased by providing the driver amplifier, the display quality can be improved.

In the data driver, the driver amplifier may be formed by a flip-around sample-hold circuit.

Since the driver amplifier can be provided with a voltage sample-hold function and an offset-free state can be implemented by utilizing the flip-around sample-hold circuit, a highly accurate voltage that varies to only a small extent can be supplied to the data line.

The data driver may further comprise:

a switch circuit that is provided between the D/A conversion circuit and the data line driver circuit, and the switch circuit may include:

a first switch element provided between a first voltage output node of the D/A conversion circuit and a first input node of the grayscale generation amplifier, the first voltage output node being an output node of the first grayscale voltage;

a second switch element that is provided between a second voltage output node of the D/A conversion circuit and the first input node of the grayscale generation amplifier and is exclusively turned ON/OFF with respect to the first switch element, the second voltage output node being an output node of the second grayscale voltage;

a third switch element provided between the first voltage output node of the D/A conversion circuit and a second input node of the grayscale generation amplifier; and a fourth switch element that is provided between the second voltage output node of the D/A conversion circuit and the second input node of the grayscale generation amplifier and is exclusively turned ON/OFF with respect to the third switch element.

According to this embodiment, the switch circuit is provided between the D/A conversion circuit that outputs the first grayscale voltage and the second grayscale voltage and the data line driver circuit that generates a grayscale voltage between the first grayscale voltage and the second grayscale voltage. The switch circuit includes a plurality of switch elements such as first to fourth switch elements. The first switch element and the second switch element receive the first grayscale voltage and the second grayscale voltage from the D/A conversion circuit, and are exclusively turned ON/OFF to output the first grayscale voltage or the second grayscale voltage to the first input node of the grayscale generation amplifier. The third switch element and the fourth switch element receive the first grayscale voltage and the second grayscale voltage from the D/A conversion circuit, and are exclusively turned ON/OFF to output the first grayscale voltage or the second grayscale voltage to the second input node of the grayscale generation amplifier. According to this configuration, the first grayscale voltage or the second grayscale voltage can be input to the first input node and the second input node of the grayscale generation amplifier. Therefore, the grayscale generation amplifier can generate and output a grayscale voltage between the first grayscale voltage and the second grayscale voltage, or output the first grayscale voltage or the second grayscale voltage. Therefore, a data driver that can reduce the number of grayscale voltages generated by the D/A conversion circuit and supply a voltage to the data line by a small circuit configuration can be implemented.

In the data driver, the first grayscale voltage may be higher than the second grayscale voltage when a jth bit (j is a natural number) of the grayscale data is set at a first logic level, and the second grayscale voltage may be higher than the first grayscale voltage when the jth bit of the grayscale data is set at a second logic level, the first switch element, the second switch element, the third switch element, and the fourth switch element may be turned ON/OFF so that the output voltage of the grayscale generation amplifier increases monotonically or decreases monotonically as data formed by lower-order bit of the jth bit increases.

The output voltage of the grayscale generation amplifier increases monotonically or decreases monotonically by performing the above-described ON/OFF control even when the relationship between the first grayscale voltage and the second grayscale voltage has changed due to a change in the jth bit of the grayscale data so that an appropriate grayscale voltage corresponding to the grayscale data can be output.

According to another embodiment of the invention, there is provided an integrated circuit device comprising one of the above data drivers.

According to another embodiment of the invention, there is provided an electronic instrument comprising the above integrated circuit device.

Preferred embodiments of the invention are described in detail below. Note that the following embodiments do not in any way limit the scope of the invention defined by the claims laid out herein. Note that all elements of the following embodiments should not necessarily be taken as essential requirements for the invention.

1. D/A Conversion Circuit

FIG. 1 shows a configuration example of the D/A conversion circuit 52. The D/A conversion circuit 52 includes a first D/A converter DACA and a second D/A converter DACB.

The first D/A converter DACA (odd-number DAC) selects a grayscale voltage (voltage) corresponding to the grayscale data (input data in a broad sense) from a plurality of grayscale voltages V1, V3, V5, V7, . . . , and Vm-1 (a plurality of input voltages in a broad sense), and outputs the selected voltage as the first grayscale voltage VG1 (first voltage).

The second D/A converter DACB (even-number DAC) selects a grayscale voltage (voltage) corresponding to the grayscale data (input data) from a plurality of grayscale voltages V0, V2, V4, V6, V8, . . . , and Vm-1 (a plurality of input voltages), and outputs the selected voltage as the second grayscale voltage VG2 (second voltage in a broad sense). The first grayscale voltage VG1 and the second grayscale voltage VG2 are voltages that differ by at least 1LSB of the grayscale data (input data), for example.

The first D/A converter DACA includes multi-stage selector blocks BL1A, BL2A, and BL3A, the output from a selector included in the selector block in the preceding stage being input to a selector included in the selector block in the subsequent stage. The second D/A converter DACB includes multi-stage selector blocks BL1B, BL2B, and BL3B, the output from a selector included in the selector block in the preceding stage being input to a selector included in the selector block in the subsequent stage. The number of stages of the selector blocks is not limited to three employed in FIG. 1, but may be two, or four or more.

Figure 2:
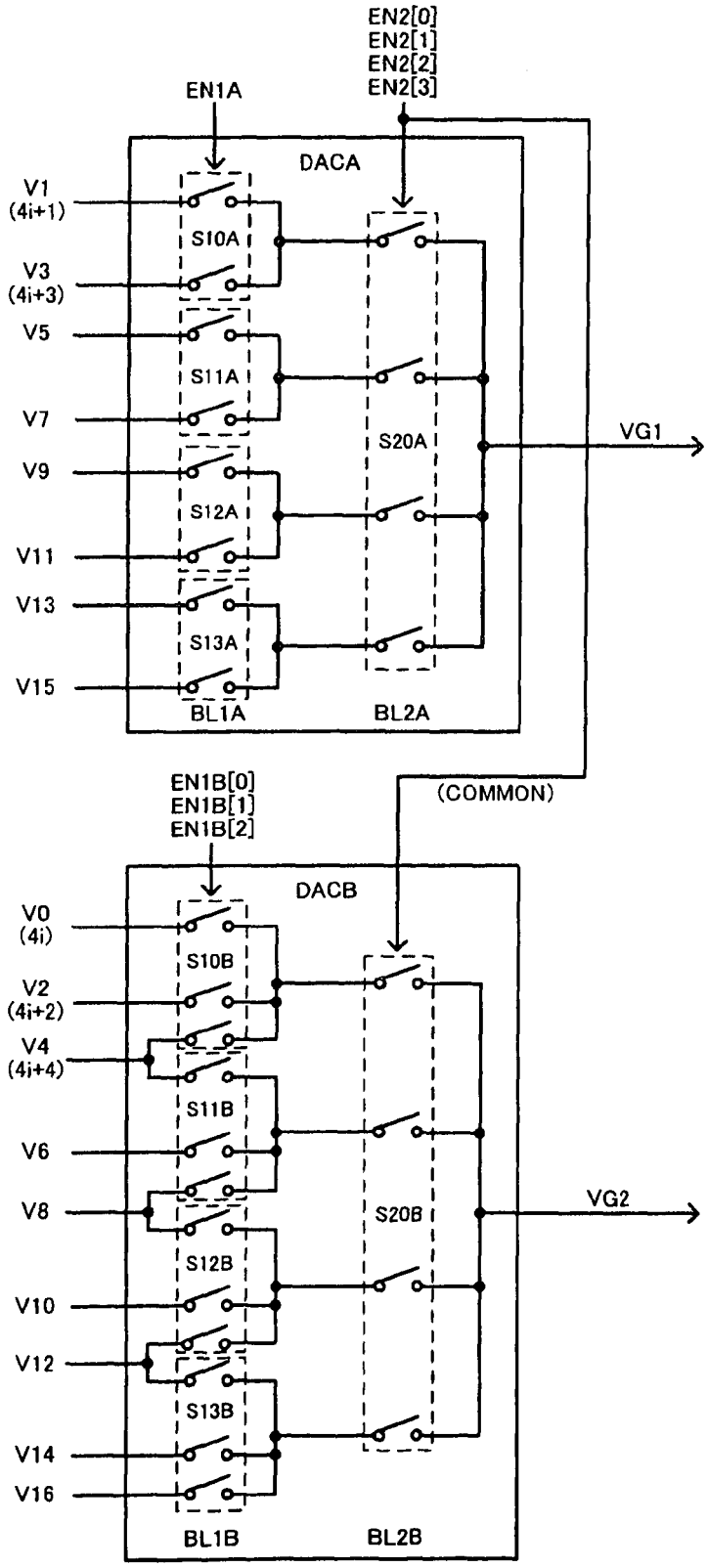
FIG. 2 shows a configuration example of a first D/A converter and a second D/A converter.

FIG. 2 shows a detailed configuration example of the first D/A converter DACA and the second D/A converter DACB. Each of the first D/A converter DACA and the second D/A converter DACB selects one grayscale voltage from a plurality of grayscale voltages by a tournament method, and outputs the selected voltage as the first grayscale voltage VG1 or the second grayscale voltage VG2.

As shown in FIG. 2, the first-stage selector block BL1A of the first D/A converter DACA includes a plurality of two-input selectors S10A to S13A (2-to-1 selectors). The first-stage selector block BL1B of the second D/A converter DACB includes a plurality of three-input selectors S10B to S13B (3-to-1 selectors). A switch element included in the selector may be formed by a transfer gate including a P-type transistor and an N-type transistor, for example.

The two-input selector S10A (ith two-input selector, i=0) among the plurality of two-input selectors of the first D/A converter DACA selects the grayscale voltage V1 ((4i+1)th input voltage) or the grayscale voltage V3 ((4i+3)th input voltage) based on the grayscale data (input data), and outputs the selected grayscale voltage to a four-input selector S20A of the selector block BL2A in the subsequent stage.

The two-input selector S11A (ith two-input selector, i=1) selects the grayscale voltage V5 ((4i+1)th input voltage) or the grayscale voltage V7 ((4i+3)th input voltage) based on the grayscale data, and outputs the selected grayscale voltage to the four-input selector S20A in the subsequent stage. This also applies to the two-input selector S12A and S13A.

The four-input selector S20A selects the output voltage from the two-input selector S10A, S11A, S12A, or S13A, and outputs the selected output voltage as the first grayscale voltage VG1.

The three-input selector S10B (ith three-input selector, i=0) among the plurality of three-input selectors of the second D/A converter DACB selects the grayscale voltage V0 (4ith input voltage), the grayscale voltage V2 ((4i+2)th input voltage), or the grayscale voltage V4 ((4i+4)th input voltage) based on the grayscale data (input data), and outputs the selected grayscale voltage to a four-input selector S20B of the selector block BL2B in the subsequent stage.

The three-input selector S11B (ith three-input selector, i=1) selects the grayscale voltage V4 (4ith input voltage), the grayscale voltage V6 ((4i+2)th input voltage), or the grayscale voltage V8 ((4i+4)th input voltage) based on the grayscale data, and outputs the selected grayscale voltage to the four-input selector S20B in the subsequent stage. This also applies to the three-input selectors S12B and S13B.

The four-input selector S20B selects the output voltage from the three-input selector S10B, S11B, S12B, or S13B and outputs the selected output voltage as the second grayscale voltage VG2

In the second D/A converter DACB, the grayscale voltage V4 is input to the three-input selectors S10B and S11B, as shown in FIG. 2. The grayscale voltage V8 is input to the three-input selectors S11B and S12B, and the grayscale voltage V12 is input to the three-input selectors S12B and S13B. The two-input selectors S10A to S13A of the first D/A converter DACA are controlled based on a selector control signal EN1A dedicated to the first D/A converter DACA.

Specifically, one of two switch elements of each of the two-input selectors S10A to S13A is turned ON and the other switch element is turned OFF based on the voltage level of the selector control signal EN1A.

The three-input selectors S10B to S13B of the second D/A converter DACB are controlled based on selector control signals EN1B[2] to EN1B[0] dedicated to the second D/A converter DACB.

Specifically, one of three switch elements of each of the three-input selectors S10B to S13B is turned ON and the remaining switch elements are turned OFF based on the voltage levels of the selector control signals EN1B[2] to EN1B[0].

The four-input selector S20A included in the second-stage (second or subsequent-stage) selector block BL2A of the first D/A converter DACA and the four-input selector S20B included in the second-stage (second or subsequent-stage) selector block BL2B of the second D/A converter FACB are controlled based on selector control signals EN2[3] to EN2[0].

Specifically, one of four switch elements of the four-input selector S20A is turned ON and the remaining switch elements are turned OFF based on the voltage levels of the selector control signals EN2[3] to EN2[0]. The first grayscale voltage VG1 is thus output from the first D/A converter DACA.

One of four switch elements of the four-input selector S20B is turned ON and the remaining switch elements are turned OFF based on the voltage levels of the selector control signals EN2[3] to EN2[0]. The second grayscale voltage VG2 is thus output from the second D/A converter DACB.

According to the configuration shown in FIG. 2, the numbers of switch elements of the selectors of the first D/A converter DACA and the second D/A converter DACB can be reduced while reducing the number of selector control signals.

Figure 3:
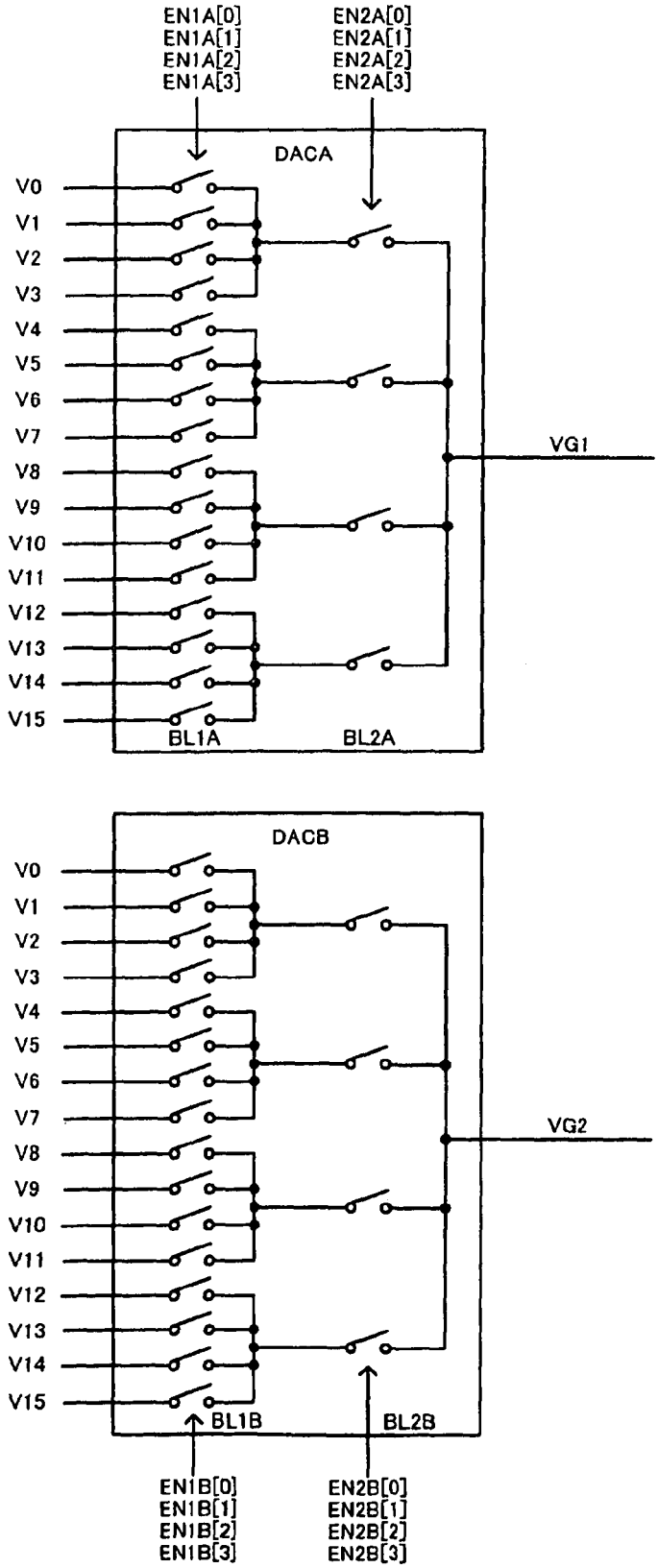
FIG. 3 shows a configuration example according to a comparative example.

FIG. 3 shows a configuration of the first D/A converter DACA and the second D/A converter DACB as a comparative example. In FIG. 3, the first D/A converter DACA is configured so that one grayscale voltage can be selected from sixteen grayscale voltages V0 to V15. The second D/A converter DACB is also configured so that one grayscale voltage can be selected from sixteen grayscale voltages V0 to V15.

A four-input selector included in the first-stage selector block BL1A of the first D/A converter DACA is controlled based on selector control signals EN1A[3] to EN1A[0], and a four-input selector included in the second-stage selector block BL2A is controlled based on selector control signals EN2A[3] to EN2A[0].

Likewise, a four-input selector included in the first-stage selector block BL1B of the second D/A converter DACB is controlled based on selector control signals EN1B[3] to EN1B[0], and a four-input selector included in the second-stage selector block BL2B is controlled based on selector control signals EN2B[3] to EN2B[0].

According to a configuration of this embodiment shown in FIG. 2, the number of switch elements can be reduced from 40 to 28 as compared with a comparative example shown in FIG. 3. Moreover, the number of selector control signals can be reduced from sixteen to eight. Therefore, the circuit area of the D/A conversion circuit 52 can be reduced as compared with FIG. 3. Moreover, since the number of selector control signals is reduced, the signal line wiring area can be reduced so that the area of the integrated circuit device can be reduced.

2. Second Configuration Example of First D/A Converter and Second D/A Converter

Figure 4:
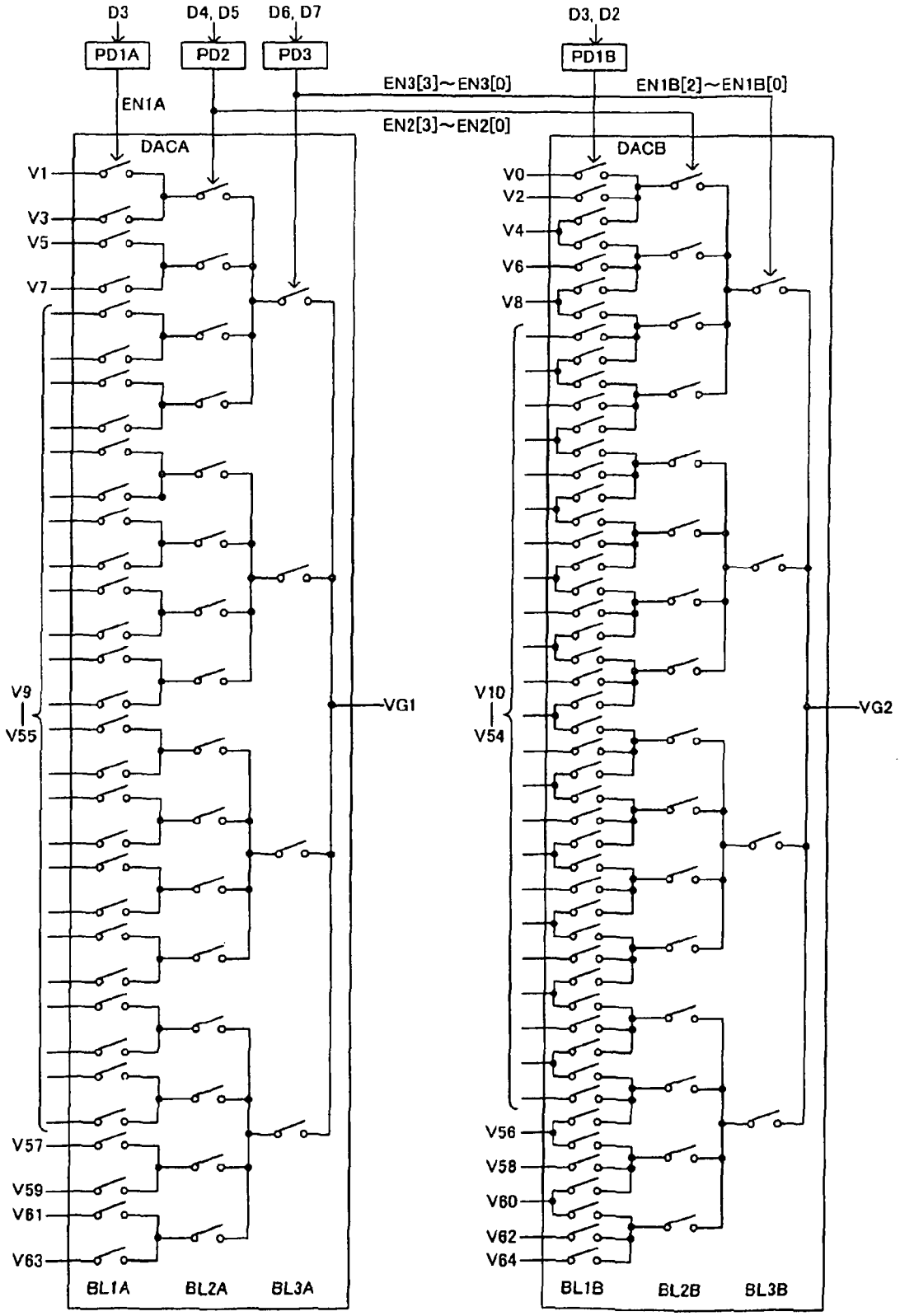
FIG. 4 shows a second configuration example of a first D/A converter and a second D/A converter.

FIG. 4 shows a second configuration example of the first D/A converter DACA and the second D/A converter DACB. In FIG. 2, the grayscale voltages V0 to V16 are input to the first D/A converter DACA and the second D/A converter DACB. In FIG. 4, the grayscale voltages V0 to V64 are input to the first D/A converter DACA and the second D/A converter DACB (i.e., the number of grayscales is increased). In FIG. 2, the number of stages of selector blocks is two. In FIG. 4, the number of stages of selector blocks is three. In FIG. 4, predecoders PD1A, PD1B, PD2, and PD3 that generate and output the selector control signals are provided.

In FIG. 4, the first-stage selector block BL1A of the first D/A converter DACA includes a plurality of two-input selectors in the same manner as in FIG. 2. The ith two-input selector (i is an integer equal to or larger than zero) among the plurality of two-input selectors selects the (4i+1)th grayscale voltage or the (4i+3)th grayscale voltage based on the grayscale data (higher-order bit of the grayscale data), and outputs the selected grayscale voltage to a four-input selector of the selector block BL2A in the subsequent stage.

Specifically, the ith two-input selector selects and outputs the (4i+1)th grayscale voltage (input voltage) or the (4i+3)th grayscale voltage (input voltage) based on the (j+1)th bit (j is a natural number) of the grayscale data (input data). In FIG. 4, the ith two-input selector selects and outputs the (4i+1)th grayscale voltage (input voltage) or the (4i+3)th grayscale voltage (input voltage) based on the third bit D3 ((j+1)th bit j=2) of the grayscale data D7 to D0. For example, the two-input selector to which the grayscale voltages V1 and V3 are input selects and outputs the grayscale voltage V1 or V3 based on the bit D3 of the grayscale data.

In FIG. 4, the first-stage selector block BL1B of the second D/A converter DACB includes a plurality of three-input selectors in the same manner as in FIG. 2. The ith three-input selector among the plurality of three-input selectors selects the 4ith grayscale voltage, the (4i+2)th grayscale voltage, or the (4i+4)th grayscale voltage based on the grayscale data (higher-order bit of the grayscale data), and outputs the selected grayscale voltage to a four-input selector of the selector block BL2B in the subsequent stage.

Specifically, the ith three-input selector selects and outputs the 4ith grayscale voltage (input voltage), the (4i+2)th grayscale voltage (input voltage), or the (4i+4)th grayscale voltage (input voltage) based on the (j+1)th bit and the jth bit of the grayscale data (input data). In FIG. 4, the ith three-input selector selects and outputs the 4ith grayscale voltage, the (4i+2)th grayscale voltage, or the (4i+4)th grayscale voltage based on the third bit D3 ((j+1)th bit, j=2) and the second bit D2 (jth bit) of the grayscale data D7 to D0. For example, the three-input selector to which the grayscale voltages V0, V2, and V4 are input selects and outputs the grayscale voltage V0, V2, or V4 based on the bit D3 and the bit D2 of the grayscale data.

For example, the bit D3 of the grayscale data is input to the predecoder PD1A. The predecoder PD1A outputs the selector control signal EN1A to the two-input selector of the first-stage selector block BL1A. One of two switch elements of the two-input selector is turned ON and the other switch element is turned OFF based on the selector control signal EN1A. The (4i+1)th grayscale voltage (e.g., V1 or V5) or the (4i+3)th (e.g., V3 or V7) is thus selected based on the bit D3, and output to the four-input selector of the selector block BL2A in the subsequent stage.

The bit D3 and the bit D2 of the grayscale data are input to the predecoder PD1B. The predecoder PD1B outputs selector control signals EN1B[2] to EN1B[0] to the three-input selector of the first-stage selector block BL1B. One of three switch elements of the three-input selector is turned ON and the remaining switch elements are turned OFF based on the selector control signals EN1B[2] to EN1B[0]. The 4ith grayscale voltage (e.g., V0 or V4), the (4i+2)th grayscale voltage (e.g., V2 or V6), or the (4i+4)th (e.g., V4 or V8) is thus selected based on the bit D3 and the bit D4, and output to the four-input selector of the selector block BL2B in the subsequent stage.

The selectors included in the second-stage or subsequent-stage selector blocks BL2A and BL3A of the first D/A converter DACA and the selectors included in the second-stage or subsequent-stage selector blocks BL2B and BL3B of the second D/A converter DACB are controlled based on common selector control signals.

For example, the bit D4 and the bit D5 of the grayscale data are input to the predecoder PD2. The predecoder PD2 outputs selector control signals EN2[3] to EN2[0]. The four-input selector included in the selector block BL2A selects the output voltage from the two-input selector of the selector block BL1A in the preceding stage. The four-input selector included in the selector block BL2B selects the output voltage from the three-input selector of the selector block BL1B in the preceding stage.

The bit D6 and the bit D7 of the grayscale data are input to the predecoder PD3. The predecoder PD3 outputs selector control signals EN3[3] to EN3[0]. The four-input selector included in the selector block BL3A selects the output voltage from the four-input selector of the selector block BL2A in the preceding stage based on the selector control signals EN3[3] to EN3[0], and outputs the selected output voltage as the first grayscale voltage VG1. The four-input selector included in the selector block BL3B selects the output voltage from the four-input selector of the selector block BL2B in the preceding stage, and outputs the selected output voltage as the second grayscale voltage VG2.

In FIG. 4, the selector control signals EN2[3] to EN2[0] and EN3[3] to EN3[0] can be used as common control signals for the first D/A converter DACA and the second D/A converter DACB, as described above. This makes it possible to provide a reduced number of selector control signal lines so that the wiring area can be significantly reduced as compared with the comparative example method shown in FIG. 3.

FIG. 5 is a view showing the relationship among the grayscale data, the grayscale voltages selected by the first D/A converter DACA and the second D/A converter DACB, and the selector control signals.

For example, when the higher-order bits D7 to D2 of the grayscale data are (000000), the selector control signal EN1A supplied to the two-input selector of the first-stage selector block BL1A of the first D/A converter DACA is set at "1" so that the upper switch element (V1) of the two-input selector in the first stage is turned ON. The selector control signals EN1B[2] to EN1B[0] supplied to the three-input selector of the first-stage selector block BL1B of the second D/A converter DACB are set at (001) so that the uppermost switch element (V0) of the three-input selector in the first stage is turned ON. The selector control signals EN2[3] to EN2[0] supplied to the four-input selectors of the second-stage selector blocks BL2A and BL2B of the first D/A converter DACA and the second D/A converter DACB are set at (0001) so that the uppermost switch elements of the four-input selectors in the second stage are turned ON. The selector control signals EN3[3] to EN3[0] supplied to the four-input selectors of the third-stage selector blocks BL3A and BL3B are set at (0001) so that the uppermost switch elements of the four-input selectors in the third stage are turned ON.

Therefore, when the higher-order bits D7 to D2 of the grayscale data are (000000), the first D/A converter DACA selects the grayscale voltage V1 (=V) and outputs the grayscale voltage V1 as the first grayscale voltage VG1, and the second D/A converter DACB selects the grayscale voltage V0 (=0) and outputs the grayscale voltage V0 as the second grayscale voltage VG2, as shown in FIG. 5. In FIG. 5, the difference between the first grayscale voltage VG1 and the second grayscale voltage VG2 is V.

When the higher-order bits D7 to D2 of the grayscale data are (000001), the selector control signal EN1A supplied to the first-stage selector block BL1A of the first D/A converter DACA is set at "1" so that the upper switch element (V1) of the two-input selector in the first stage is turned ON. The selector control signals EN1B[2] to EN1B[0] supplied to the first-stage selector block BU1B of the second D/A converter DACB are set at (010) so that the middle switch element (V2) of the three-input selector in the first stage is turned ON. The selector control signals EN2[3] to EN2[0] and EN3[3] to EN3[0] supplied to the second-stage selector blocks BL2A and BL2B and the third-stage selector blocks BL3A and BL3B of the first D/A converter DACA and the second D/A converter DACB are set at (0001) so that the uppermost switch elements of the four-input selectors in the second stage and the third stage are turned ON.

Therefore, when the higher-order bits D7 to D2 of the grayscale data are (000001), the first D/A converter DACA selects the grayscale voltage V1 (=V) and outputs the grayscale voltage V1 as the first grayscale voltage VG1, and the second D/A converter DACB selects the grayscale voltage V2 (=2V) and outputs the grayscale voltage V2 as the second grayscale voltage VG2.

When the higher-order bits D7 to D2 of the grayscale data are (000010), the selector control signal EN1A supplied to the first-stage selector block BL1A of the first D/A converter DACA is set at "0" so that the lower switch element (V3) of the two-input selector in the first stage is turned ON. The selector control signals EN1B[2] to EN1B[0] supplied to the first-stage selector block BL1B of the second D/A converter DACB are set at (010) so that the middle switch element (V2) of the three-input selector in the first stage is turned ON. The selector control signals EN2[3] to EN2[0] and EN3[3] to EN3[0] supplied to the second-stage selector blocks BL2A and BL2B and the third-stage selector blocks BL3A and BL3B of the first D/A converter DACA and the second D/A converter DACB are set at (0001) so that the uppermost switch elements of the four-input selectors in the second stage and the third stage are turned ON.

Therefore, when the higher-order bits 97 to D2 of the grayscale data are (000010), the first D/A converter DACA selects the grayscale voltage V3 (=3V) and outputs the grayscale voltage V3 as the first grayscale voltage VG1, and the second D/A converter DACB selects the grayscale voltage V2 (=2V) and outputs the grayscale voltage V2 as the second grayscale voltage VG2, as shown in FIG. 5.

When the higher-order bits D7 to D2 of the grayscale data are (000011), the selector control signal EN1A supplied to the first-stage selector block BL1A of the first D/A converter DACA is set at "0" so that the lower switch element (V3) of the two-input selector in the first stage is turned ON. The selector control signals EN1B[2] to EN1B[0] supplied to the first-stage selector block BL1B of the second D/A converter DACB are set at (100) so that the lowermost switch element (V4) of the three-input selector in the first stage is turned ON. The selector control signals EN2[3] to EN2[0] and EN3[3] to EN3[0] supplied to the second-stage selector blocks BL2A and BL2B and the third-stage selector blocks BL3A and BL3B of the first D/A converter DACA and the second D/A converter DACB are set at (0001) so that the uppermost switch elements of the four-input selectors in the second stage and the third stage are turned ON.

Therefore, when the higher-order bits D7 to D2 of the grayscale data are (000011), the first D/A converter DACA selects the grayscale voltage V3 (=3V) and outputs the grayscale voltage V3 as the first grayscale voltage VG1, and the second D/A converter DACB selects the grayscale voltage V4 (=4V) and outputs the grayscale voltage V4 as the second grayscale voltage VG2, as shown in FIG. 5.

According to the configuration shown in FIG. 4, the first D/A converter DACA and the second D/A converter DACB respectively output the first grayscale voltage VG1 and the second grayscale voltage VG2 which monotonically increase (or monotonically decrease) as the grayscale data increases and of which the difference is V.

As shown in FIG. 5, the selector control signal EN1A supplied to the first-stage selector block BL1A of the first D/A converter DACA changes when the bit D3 (j+1)th bit) of the grayscale data changes. Therefore, the two-input selector of the first-stage selector block BL1A of the first D/A converter DACA selects the voltage based on the bit D3, and the predecoder PD/A shown in FIG. 4 decodes the bit D3 to generate the selector control signal EN1A.

As shown in FIG. 5, the selector control signals EN1B[3] to EN1B[0] supplied to the first-stage selector block BL1B of the second D/A converter DACB change when the bit D3 ((j+1)th bit) or the bit D2 (jth bit) of the grayscale data changes. Therefore, the three-input selector of the first-stage selector block BL1B of the second D/A converter DACB selects the voltage based on the bit D3 and the bit D2, and the predecoder PD1B shown in FIG. 4 decodes the bit D3 and the bit D2 to generate the selector control signals EN1B[3] to EN1B[0].

On the other hand, the selector control signals EN2[3] to EN2[0] and EN3[3] to EN3[0] can be used in common for the first D/A converter DACA and the second D/A converter DACB, as shown in FIG. 5.

Figure 6:
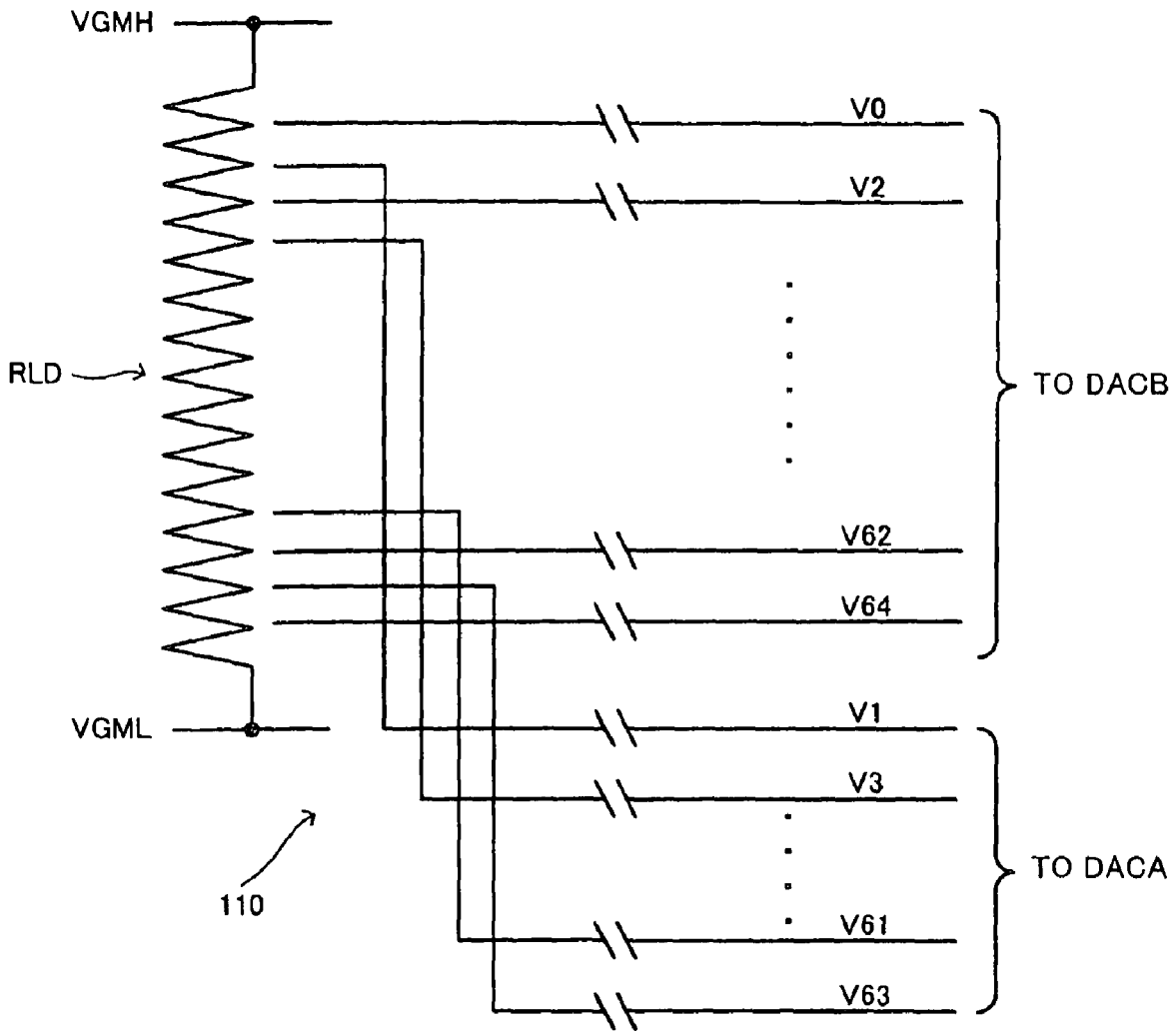
FIG. 6 shows a configuration example of a grayscale voltage generation circuit.

FIG. 6 shows a configuration example of a grayscale voltage generation circuit 110 that generates the grayscale voltages supplied to the D/A converter circuit 52. The grayscale voltage generation circuit 110 includes a ladder resistor circuit RDL provided between a first grayscale generation power supply VGMH and a second grayscale generation power supply VGML. The grayscale voltage generation circuit 110 generates the grayscale voltages V0 to V63 at respective tap positions of the ladder resistor circuit RDL. The grayscale voltage generation circuit 110 supplies the grayscale voltages V1, V3, V5, . . . , V61, and V63 to the first D/A converter DACA shown in FIG. 4, and supplies the grayscale voltages V0, V2, V4 . . . , V60, V62, and V64 to the second D/A converter DACB. The grayscale voltage generation circuit 110 may further include an operational amplifier that subjects the voltage divided by the ladder resistor circuit RDL to impedance conversion, for example.

3. Integrated Circuit Device

Figure 7:
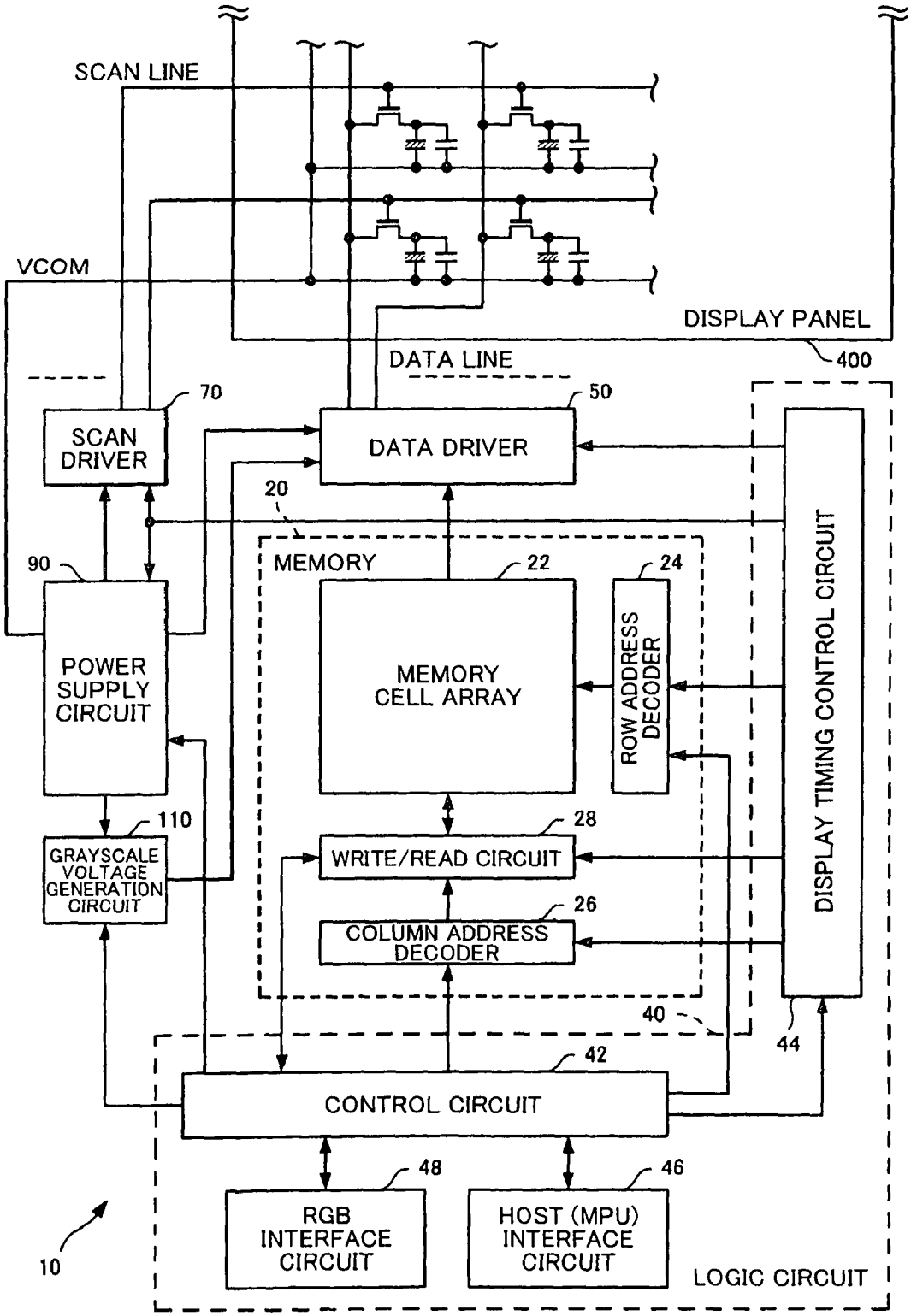
FIG. 7 shows a configuration example of an integrated circuit device according to one embodiment of the invention.

FIG. 7 shows a circuit configuration example of an integrated circuit device 10 (display driver) including a data driver according to one embodiment of the invention. Note that the integrated circuit device 10 according to this embodiment is not limited to the configuration shown in FIG. 7. Various modifications may be made such as omitting some of the elements or adding other elements.

A display panel 400 (electro-optical device in a broad sense) includes a plurality of data lines (source lines), a plurality of scan lines (gate lines), and a plurality of pixels specified by the data lines and the scan lines. A display operation is implemented by changing the optical properties of an electro-optical element (liquid crystal element in a narrow sense) in each pixel area. The display panel may be implemented by an active matrix panel using a switch element such as a TFT or a TFD, for example. Note that the display panel may be a panel other than the active matrix panel, or may be a panel (e.g., organic EL panel) other than the liquid crystal panel.

A memory 20 (display data RAM) stores image data. A memory cell array 22 includes a plurality of memory cells, and stores image data (display data) corresponding to at least one frame (one screen). A row address decoder 24 (MPU/LCD row address decoder) decodes a row address, and selects a wordline of the memory cell array 22. A column address decoder 26 (MPU column address decoder) decodes a column address, and selects a bitline of the memory cell array 22. A write/read circuit 28 (MPU write/read circuit) writes image data into the memory cell array 22, or reads image data from the memory cell array 22.

A logic circuit 40 (driver logic circuit) generates a control signal for controlling a display timing, a control signal for controlling a data processing timing, and the like. The logic circuit 40 may be formed by automatic placement and routing (e.g., gate array (G/A)), for example.

A control circuit 42 generates various control signals, and controls the entire device. Specifically, the control circuit 42 outputs grayscale adjustment data (gamma correction data)

for adjusting grayscale characteristics (gamma characteristics) to a grayscale voltage generation circuit 110, or outputs power supply adjustment data for adjusting a power supply voltage to a power supply circuit 90. The control circuit 42 also controls a memory write/read process using the row address decoder 24, the column address decoder 26, and the write/read circuit 28.

A display timing control circuit 44 generates various control signals for controlling the display timing, and controls reading of image data from the memory 20 into the display panel. A host (MPU) interface circuit 46 implements a host interface that generates an internal pulse corresponding to each access from a host and accesses the memory 20. An RGB interface circuit 48 implements an RGB interface that writes motion picture RGB data into the memory 20 based on a dot clock signal. Note that the integrated circuit device 10 may be configured to include only one of the host interface circuit 46 and the RGB interface circuit 48.

A data driver 50 is a circuit that generates a data signal for driving the data line of the display panel. Specifically, the data driver 50 receives image data (grayscale data or display data) from the memory 20, and receives a plurality of (e.g., 256-stage) grayscale voltages (reference voltages) from the grayscale voltage generation circuit 110. The data driver 50 selects a voltage corresponding to the image data (grayscale data) from the plurality of grayscale voltages, and outputs the selected voltage to the data line of the display panel.

A scan driver 70 is a circuit that generates a scan signal for driving the scan line of the display panel. Specifically, the scan driver 70 sequentially shifts a signal (enable input-output signal) using a built-in shift register, and outputs a signal obtained by converting the level of the shifted signal to each scan line of the display panel as the scan signal (scan voltage). The scan driver 70 may include a scan address generation circuit and an address decoder. The scan address generation circuit may generate and output a scan address, and the address decoder may decode the scan address to generate the scan signal.

The power supply circuit 90 is a circuit that generates various power supply voltages. Specifically, the power supply circuit 90 increases an input power source voltage or an internal power supply voltage by a charge-pump method using a boost capacitor and a boost transistor included in a voltage booster circuit provided in the power supply circuit 90. The power supply circuit 90 supplies the resulting voltages to the data driver 50, the scan driver 70, the grayscale voltage generation circuit 110, and the like.

The grayscale voltage generation circuit 110 (gamma correction circuit) is a circuit that generates the grayscale voltage and supplies the grayscale voltage to the data driver 50. Specifically, the grayscale voltage generation circuit 110 may include a ladder resistor circuit that divides the voltage between a high-potential-side voltage and a low-potential-side voltage using resistors, and outputs the grayscale voltages to resistance division nodes. The grayscale voltage generation circuit 110 may also include a grayscale register section into which the grayscale adjustment data is written, a grayscale voltage setting circuit that variably sets (controls) the grayscale voltage output to the resistance division node based on the grayscale adjustment data written into the grayscale register section, and the like.

4. Data Driver

Figure 8:
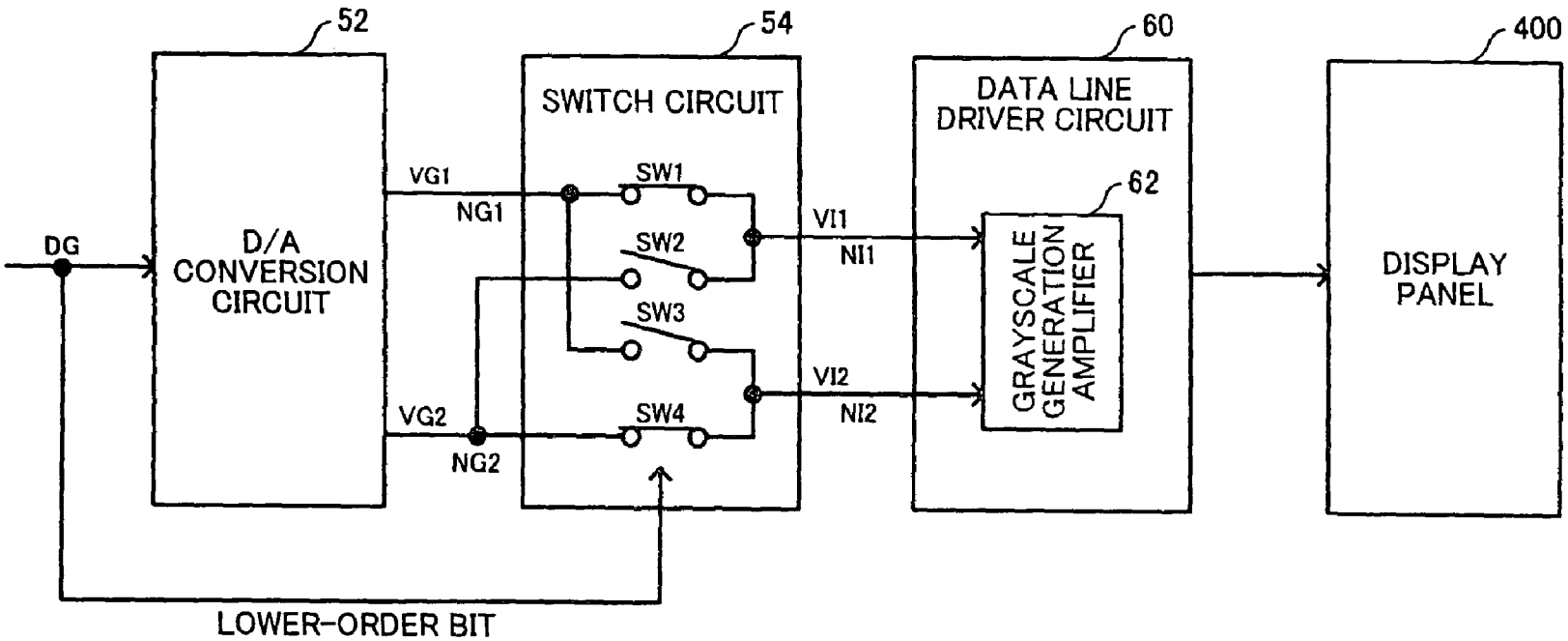
FIG. 8 shows a configuration example of a data driver according to one embodiment of the invention.

FIG. 8 shows a configuration example of the data driver (source driver) according to this embodiment. The data driver drives the data line of the display panel 400 (electro-optical device) such as a liquid crystal panel. The data driver includes the D/A conversion circuit 52, a switch circuit 54, and a data line driver circuit 60.

The data line driver circuit 60 and the like may be provided corresponding to each data line of the display panel 400, or the data line driver circuit 60 may drive a plurality of data lines by time division. A plurality of data line driver circuits 60 may share one D/A conversion circuit 52. Part or the entirety of the data driver (integrated circuit device) may be integrally formed on the display panel 400.

The D/A conversion circuit 52 (voltage generation circuit) receives grayscale data DG (image data or display data) from the memory 20 shown in FIG. 7, for example. The D/A conversion circuit 52 outputs the first grayscale voltage VG1 and the second grayscale voltage VG2 corresponding to the grayscale data DG.

Specifically, the D/A conversion circuit 52 receives a plurality of grayscale voltages (e.g., V0 to V128 or V0 to V64) from the grayscale voltage generation circuit 110 shown in FIG. 7 through grayscale voltage lines. The D/A conversion circuit 52 selects and outputs the first grayscale voltage VG1 and the second grayscale voltage VG2 corresponding to the grayscale data DG from the plurality of grayscale voltages. In this case, the first grayscale voltage VG1 and the second grayscale voltage VG2 output from the D/A conversion circuit 52 are consecutive (adjacent) grayscale voltages. Specifically, the first grayscale voltage VG1 and the second grayscale voltage VG2 are consecutive grayscale voltages (e.g., V0 and V1, V1 and V2, or V2 and V3) among a plurality of grayscale voltages (V0 to V128 or V0 to V64) input to the D/A conversion circuit 52 through the grayscale voltage lines.

In FIG. 9, the grayscale data DG is 8-bit (256 grayscales) data (D7 to D0), for example. A plurality of grayscale voltages V0 to V128 are input to the D/A conversion circuit 52. In this example, the grayscale voltages V0 to V128 have a monotonically decreasing relationship (i.e., V0>V1>V2 . . . V127>V128). Note that the grayscale voltages V0 to V128 may have a monotonically increasing relationship (i.e., V0<V1<V2 . . . V127<V128).

The D/A conversion circuit 52 outputs the grayscale voltage V1 and the grayscale voltage V0 as the first grayscale voltage VG1 and the second grayscale voltage VG2 (i.e., VG1=V1 and VG2=V0), respectively, when the grayscale data DG (D7 to D0) is (00000000) or (00000001), and outputs the grayscale voltage V1 and the grayscale voltage V2 as the first grayscale voltage VG1 and the second grayscale voltage VG2 (i.e., VG1=V1 and VG2=V2), respectively, when the grayscale data DG (D7 to D0) is (00000010) or (00000011). The D/A conversion circuit 52 outputs the grayscale voltage V3 and the grayscale voltage V2 as the first grayscale voltage VG1 and the second grayscale voltage VG2 (i.e., VG1=V3 and VG2=V2), respectively, when the grayscale data DG (D7 to D0) is (00000100) or (00000101), and outputs the grayscale voltage V3 and the grayscale voltage V4 as the first grayscale voltage VG1 and the second grayscale voltage VG2 (i.e., VG1=V3 and VG2=V4), respectively, when the grayscale data DG (D7 to D0) is (00000110) or (00000111).

The D/A conversion circuit 52 thus outputs consecutive grayscale voltages corresponding to the grayscale data DG among the grayscale voltages V0 to V128 input from the grayscale voltage generation circuit 110 as the first grayscale voltage VG1 and the second grayscale voltage VG2. Although FIGS. 8 and 9 illustrate an example in which the D/A conversion circuit 52 generates two grayscale voltages (i.e., first grayscale voltage VG1 and second grayscale voltage VG2), the types (number) of grayscale voltages output from the D/A conversion circuit 52 are not limited thereto.

The data line driver circuit 60 (data line driver circuits 60-1 to 60-N) is a circuit that drives the data line of the display panel 400, and includes a grayscale generation amplifier 62 (grayscale generation amplifiers 62-1 to 62-N). The grayscale generation amplifier 62 (grayscale generation sample-hold circuit) generates and outputs a grayscale voltage between the first grayscale voltage VG1 and the second grayscale voltage VG2.

In FIG. 9, when the grayscale data DG is (00000001), the grayscale generation amplifier 62 generates (samples) and outputs the voltage (V0−(V0−V1)/2) between the first grayscale voltage VG1 (=V1) and the second grayscale voltage VG2 (=V0) as a grayscale voltage VS. When the grayscale data DG is (00000000), the grayscale generation amplifier 62 outputs the grayscale voltage V0 (=VG2) as the grayscale voltage VS. When the grayscale data DOG is (00000011), the grayscale generation amplifier 62 generates and outputs the voltage (V1−(V1−V2)/2) between the first grayscale voltage VG1 (=V1) and the second grayscale voltage VG2 (=V2) as the grayscale voltage VS. When the grayscale data DG is (00000010), the grayscale generation amplifier 62 outputs the grayscale voltage V1 (=VG1) as the grayscale voltage VS.

The switch circuit 54 is provided between the D/A conversion circuit 52 and the data line driver circuit 60. The switch circuit 54 may be an element of the D/A conversion circuit 52 or the data line driver circuit 60.

The switch circuit 54 includes a plurality of switch elements. In FIG. 8, the switch circuit 54 includes a first switch element SW1 to a fourth switch element SW4, for example. Note that the number of switch elements is not limited to four, but may be eight, sixteen, or the like (described later). The switch elements SW1 to SW4 may be formed by CMOS transistors. Specifically, the switch elements SW1 to SW4 may be formed by transfer gates including a P-type transistor and an N-type transistor. These transistors are turned ON/OFF based on switch control signals output from a switch control signal generation circuit (not shown).

The switch element SW1 is provided between a first voltage output node NG1 (i.e., output node of the first grayscale voltage VG1) of the D/A conversion circuit 52 and a first input node NI1 of the grayscale generation amplifier 62 (data line driver circuit 60). The switch element SW2 is provided between a second voltage output node NG2 (i.e., output node of the second grayscale voltage VG2) of the D/A conversion circuit 52 and the input node NI1 of the grayscale generation amplifier 62. The switch element SW1 and the switch element SW2 are exclusively turned ON/OFF. As shown in FIG. 9, the switch element SW1 is turned OFF and the switch element SW2 is turned ON when the grayscale data DG is (00000000), and the switch element SW1 is turned ON and the switch element SW2 is turned OFF when the grayscale data DG is (00000001), for example.

The switch element SW3 is provided between the voltage output node NG1 of the D/A conversion circuit 52 and an input node NI2 of the grayscale generation amplifier 62. The switch element SW4 is provided between the voltage output node NG2 of the D/A conversion circuit 52 and the input node NI2 of the grayscale generation amplifier 62. The switch element SW3 and the switch element SW4 are exclusively turned ON/OFF. For example, the switch element SW3 is turned OFF and the switch element SW4 is turned ON when the grayscale data DG is (00000001), and the switch element SW3 is turned ON and the switch element SW4 is turned OFF when the grayscale data DG is (00000010).

As shown in FIG. 9, when the grayscale data DG is (00000000), the D/A conversion circuit 52 outputs the grayscale voltage V1 and the grayscale voltage V0 as the first grayscale voltage VG1 and the second grayscale voltage VG2, respectively. The switch elements SW1, SW2, SW3, and SW4 of the switch circuit 54 are turned OFF, ON, OFF, and ON, respectively. Therefore, a grayscale voltage VI1 (=VG2=V0) and a grayscale voltage VI2 (=VG2=V0) are respectively input to the input node NI1 and the input node NI2 of the grayscale generation amplifier 62. The grayscale generation amplifier 62 thus outputs the grayscale voltage V0 as the grayscale voltage VS (sampling voltage).

When the grayscale data DG is (00000001), the switch elements SW1, SW2, SW3, and SW4 are turned ON, OFF, OFF, and ON, respectively. Therefore, the grayscale voltage VI1 (=VG1=V1) and the grayscale voltage VI2 (=VG2=V0) are respectively input to the input node NI1 and the input node NI2 of the grayscale generation amplifier 62 so that the grayscale generation amplifier 62 outputs the voltage (V0−(V0−V1)/2) as the grayscale voltage VS. Specifically, the grayscale generation amplifier 62 outputs the grayscale voltage corresponding to the grayscale data DG (=(00000001)).

When the grayscale data DG is (00000010), the D/A conversion circuit 52 outputs the grayscale voltage V1 and the grayscale voltage V2 as the first grayscale voltage VG1 and the second grayscale voltage VG2, respectively. The switch elements SW1, SW2, SW3, and SW4 are turned ON, OFF, ON, and OFF, respectively. Therefore, the grayscale voltage VI1 (=VG1=V1) and the grayscale voltage VI2 (=VG1=V1) are respectively input to the input node NI1 and the input node NI2 of the grayscale generation amplifier 62 so that the grayscale generation amplifier 62 outputs the grayscale voltage V1 as the grayscale voltage VS.

When the grayscale data DG is (00000011), the switch elements SW1, SW2, SW3, and SW4 are turned OFF, ON, ON, and OFF, respectively. Therefore, the grayscale voltage VI1 (=VG2=V2) and the grayscale voltage VI2 (=VG1=V1) are respectively input to the input node NI1 and the input node NI2 of the grayscale generation amplifier 62 so that the grayscale generation amplifier 62 outputs the voltage (V1−(V1−V2)/2) as the grayscale voltage VS. Specifically, the grayscale generation amplifier 62 outputs the grayscale voltage corresponding to the grayscale data DG (=(00000011)).

As shown in FIG. 9, the switch elements SW1 to SW4 are turned ON/OFF based on the lower-order bits of the grayscale data DG. Specifically, the switch elements SW1 to SW4 are turned ON/OFF based on switch control signals generated based on the lower-order bits of the grayscale data DG. For example, when the lower-order bits D1 and D0 of the grayscale data DG are (00), the switch elements SW1, SW2, SW3, and SW4 are turned OFF, ON, OFF, and ON, respectively, as shown in FIG. 9. When the lower-order bits D1 and D0 of the grayscale data DOG are (01), the switch elements SW1, SW2, SW3, and SW4 are turned ON, OFF, OFF, and ON, respectively. When the lower-order bits D1 and D0 of the grayscale data DG are (10), the switch elements SW1, SW2, SW3, and SW4 are turned ON, OFF, ON, and OFF, respectively. When the lower-order bits D1 and D0 of the grayscale data DOG are (11), the switch elements SW1, SW2, SW3, and SW4 are turned OFF, ON, ON, and OFF, respectively.

Since the above-described data driver according to this embodiment can generate the grayscale voltage using the grayscale generation amplifier 62, the number (types) of grayscale voltages generated by the grayscale voltage generation circuit 110 shown in FIG. 7 can be reduced. This makes it possible to reduce the number of grayscale voltage lines while reducing the circuit scale of the D/A conversion circuit 52.

For example, when the number of bits of the grayscale data DG is eight (i.e., the number of grayscales is $2^8$ (=256)), the grayscale voltage generation circuit 110 must generate 256 grayscale voltages when using a related-art method. Therefore, the D/A conversion circuit 52 must include selectors that select the grayscale voltages corresponding to the grayscale data DG from the 256 grayscale voltages. This increases the circuit scale of the grayscale voltage generation circuit 110 and the D/A conversion circuit 52. Moreover, since 256 grayscale voltage lines are required, the wiring area increases.

On the other hand, since the data driver according to this embodiment shown in FIG. 8 generates the grayscale voltage using the grayscale generation amplifier 62, it suffices that the grayscale voltage generation circuit 110 generate 128 grayscale voltages, for example. Therefore, it suffices that the D/A conversion circuit 52 include selectors that select voltages from the 128 grayscale voltages. Accordingly, the circuit scale can be significantly reduced as compared with the related-art method. Moreover, since the number of grayscale voltage lines can be reduced to 128, the wiring area can be significantly reduced. Note that 129 (=128+1) grayscale voltage lines are required in the above-described case since the grayscale generation amplifier 62 generates a voltage by dividing the voltage between the first grayscale voltage VG1 and the second grayscale voltage VG2.

According to the data driver shown in FIG. 8, the grayscale generation amplifier 62 has a sample-hold function. Therefore, a voltage that varies to only a small extent can be supplied to the data line without performing a DAC drive operation in which the D/A conversion circuit 52 directly drives the data line. Specifically, an accurate voltage can be supplied to the data line by a relatively small and simple circuit configuration. Since the grayscale generation amplifier 62 has a sample-hold function, a plurality of data line driver circuits 60 can share one D/A conversion circuit 52. Therefore, the circuit scale can be further reduced.

According to the data driver shown in FIG. 8, the switch circuit 54 is provided between the D/A conversion circuit 52 and the data line driver circuit 60. Therefore, the input voltages (VI1, VI2)=(V0, V0), (V1, V0), (V1, V1), (V2, V1), . . . can be input to the grayscale generation amplifier 62 (see FIG. 9) based on the first grayscale voltage VG1 and the second grayscale voltage VG2 output from the D/A conversion circuit 52, for example. As a result, the grayscale generation amplifier 62 can output the grayscale voltage that decreases monotonically (or increases monotonically) (e.g., VS=V0, V0−(V0−V1)/2, V1, V1−(V1−V2)/2, V2, . . . ) so that an appropriate grayscale voltage can be output by a simple circuit configuration.

5. Flip-Around Sample-Hold Circuit

The grayscale generation amplifier 62 may be formed by a flip-around sample-hold circuit. The term "flip-around sample-hold circuit" refers to a circuit that samples a charge corresponding to an input voltage using a sampling capacitor in a sampling period, and performs a flip-around operation of the sampling capacitor in a holding period to output a voltage corresponding to the stored charge to its output node, for example.

The flip-around sample-hold circuit is described in detail below with reference to FIGS. 10A and 10B.

In FIGS. 10A and 10B, the grayscale generation amplifier 62 formed by a flip-around sample-hold circuit includes an operational amplifier OP1 and first and second sampling capacitors CS1 and CS2 (a plurality of sampling capacitors), for example.

The sampling capacitor CS1 is provided between an inverting input terminal (first input terminal in a broad sense) of the operational amplifier OP1 and the input node NI1 of the grayscale generation amplifier 62. As shown in FIG. 10A, the capacitor CS1 stores a charge corresponding to the input voltage VI1 at the input node NI1 in the sampling period.

The sampling capacitor CS2 is provided between the inverting input terminal of the operational amplifier OP1 and the input node NI2 of the grayscale generation amplifier 62. The capacitor CS2 stores a charge corresponding to the input voltage VI2 at the input node NI2 in the sampling period.

As shown in FIG. 10A, the output from the operational amplifier OP1 is fed back to a node NEG of the inverting input terminal of the operational amplifier OP1 in the sampling period. A non-inverting input terminal (second input terminal in a broad sense) of the operational amplifier OP1 is set at an analog reference voltage AGND. Therefore, the node NEG connected to one end of the capacitors CS1 and CS2 is set at the analog reference voltage AGND due to a virtual short-circuit function of the operational amplifier OP1. As a result, charges corresponding to the input voltages VI1 and VI2 are respectively stored in the capacitors CS1 and CS2.

In the holding period, the grayscale generation amplifier 62 outputs an output voltage VQG (=VS) corresponding to the charges stored in the sampling capacitors CS1 and CS2 in the sampling period to an output node NQG, as shown in FIG. 10B. Specifically, the grayscale generation amplifier 62 outputs the output voltage VQG corresponding to the charges stored in the sampling capacitors CS1 and CS2 by performing a flip-around operation that connects the other end of the capacitors CS1 and CS2 connected to the node NEG at one end to an output terminal of the operational amplifier OP1.

An offset-free state can be implemented by forming the grayscale generation amplifier 62 using the above-described flip-around sample-hold circuit.

For example, an offset voltage generated between the inverting input terminal and the non-inverting input terminal of the operational amplifier OP1 is referred to as VOF, the analog reference voltage AGND is set at 0 V, the input voltages in the sampling period are set at VI1−VI2=VI, and the parallel capacitance of the capacitors CS1 and CS2 (connected in parallel) is referred to as CS. In this case, a charge Q stored in the sampling period is expressed by the following equation.

$$Q=(VI-VOF)\times CS \tag{1}$$

When the voltage of the node NEG in the holding period is referred to as VX and the output voltage is referred to as VQG, a charge Q' stored in the holding period is expressed by the following equation.

$$Q'=(VQG-VX)\times CS \tag{2}$$

When the amplification factor of the operational amplifier OP1 is referred to as A, the output voltage VQG is expressed by the following equation.

$$VQG=-A\times(VX-VOF) \tag{3}$$

Since Q=Q' is satisfied according to the principle of charge conservation, the following equation is satisfied.

$$(VI-VOF)\times CS=(VQG-VX)\times CS \tag{4}$$

Therefore, the following equation is satisfied from the equations (3) and (4).

$$VQG=VI-VOF+VX=VI-VOF+VOF-VQG/A$$

Therefore, the output voltage VQG of the grayscale generation amplifier 62 is expressed by the following equation.

$$VQG=\{1/(1+1/A)\}\times VI \tag{5}$$

As is clear from the equation (5), since the output voltage VQG of the grayscale generation amplifier 62 is independent of the offset voltage VOF so that an offset can be canceled, an offset-free state can be implemented.

For example, when a plurality of data line driver circuits 60 drive a plurality of data lines, the output voltage VQG varies between the data lines when the offset voltage VOF is involved in the output voltage VQG, whereby the display quality deteriorates.

On the other hand, since an offset can be canceled by utilizing the flip-around sample-hold circuit, a variation in the output voltage VQG between the data lines can be minimized. Therefore, an accurate voltage that varies to only a small extent can be supplied to the data line so that the display quality can be improved. Moreover, since a DAC drive operation that directly drives the data line using the D/A conversion circuit 52 becomes unnecessary, high-speed drive and simplified control can be implemented.

FIGS. 11A and 11B show a specific configuration example of the grayscale generation amplifier 62 using the flip-around sample-hold circuit.

The grayscale generation amplifier 62 shown in FIGS. 11A and 11B includes the operational amplifier OP1, first and second sampling switch elements SS1 and SS2, the first and second sampling capacitors CS1 and CS2, a feedback switch element SFG, and first and second flip-around switch elements SA1 and SA2. The grayscale generation amplifier 62 also includes an output switch element SQG. Note that modifications may be made such as omitting some of the elements or adding other elements. The switch elements SS1, SS2, SA1, SA2, SFG, and SQG may be formed by CMOS transistors (e.g., transfer gate), for example.

The non-inverting input terminal (second input terminal) of the operational amplifier OP1 is set at the analog reference voltage AGND (given reference voltage in a broad sense).

The sampling switch element SS1 and the sampling capacitor CS1 are provided between the input node NI1 of the grayscale generation amplifier 62 and the inverting input terminal (first input terminal) of the operational amplifier OP. The sampling switch element SS2 and the sampling capacitor CS2 are provided between the input node NI2 of the grayscale generation amplifier 62 and the inverting input terminal of the operational amplifier OP1.

The feedback switch element SFG is provided between the output terminal and the inverting input terminal of the operational amplifier OP1.

The flip-around switch element SA1 is provided between a first connection node NS1 situated between the switch element SS1 and the capacitor CS1 and the output terminal of the operational amplifier OP1. The flip-around switch element SA2 is provided between a second connection node NS2 situated between the switch element SS2 and the capacitor CS2 and the output terminal of the operational amplifier OP1.

In the sampling period, the sampling switch elements SS1 and SS2 and the feedback switch element SFG are turned ON, and the flip-around switch elements SA1 and SA2 are turned OFF, as shown in FIG. 11A. This implements the sampling operation of the flip-around sample-hold circuit described with reference to FIG. 10A.

In the holding period, the sampling switch elements SS1 and SS2 and the feedback switch element SFG are turned OFF, and the flip-around switch elements SA1 and SA2 are turned ON, as shown in FIG. 11B. This implements the holding operation of the flip-around sample-hold circuit described with reference to FIG. 10B.

The output switch element SQG is provided between the output terminal of the operational amplifier OP1 and the output node NQG of the grayscale generation amplifier 62. In the sampling period, the output switch element SQG is turned OFF, as shown in FIG. 11A. This causes the output of the grayscale generation amplifier 62 to be set in a high impedance state so that a situation in which an indefinite voltage in the sampling period is transmitted to the subsequent stage can be prevented.

In the holding period, the output switch element SQG is turned ON, as shown in FIG. 11B. Therefore, the voltage VQG (i.e., the grayscale voltage generated in the sampling period) can be output.

The operation of the circuit shown in FIGS. 11A and 11B is described below with reference to FIG. 12. The first grayscale voltage VG1 from the D/A conversion circuit 52 is input to the node NG1, and the second grayscale voltage VG2 that differs in voltage level from the first grayscale voltage VG1 (as described with reference to FIG. 9) is input to the node NG2.

One of the switch elements SW1 and SW2 of the switch circuit 54 is exclusively turned ON corresponding to the grayscale data DG, as described with reference to FIG. 9. One of the switch elements SW3 and SW4 is exclusively turned ON corresponding to the grayscale data DG.

In the sampling period, switch control signals input to the sampling switch elements SS1 and SS2 and the feedback switch element SFG are activated (H level) so that the sampling switch elements SS1 and SS2 and the feedback switch element SFG are turned ON. On the other hand, switch control signals input to the flip-around switch elements SA1 and SA2 and the output switch element SQG are inactivated (L level) so that the flip-around switch elements SA1 and SA2 and the output switch element SQG are turned OFF.

In the holding period, the switch control signals input to the sampling switch elements SS1 and SS2 and the feedback switch element SFG are inactivated so that the sampling switch elements SS1 and SS2 and the feedback switch element SFG are turned OFF. On the other hand, the switch control signals input to the flip-around switch elements SA1 and SA2 and the output switch element SQG are activated so that the flip-around switch elements SA1 and SA2 and the output switch element SQG are turned ON.

Figure 12:
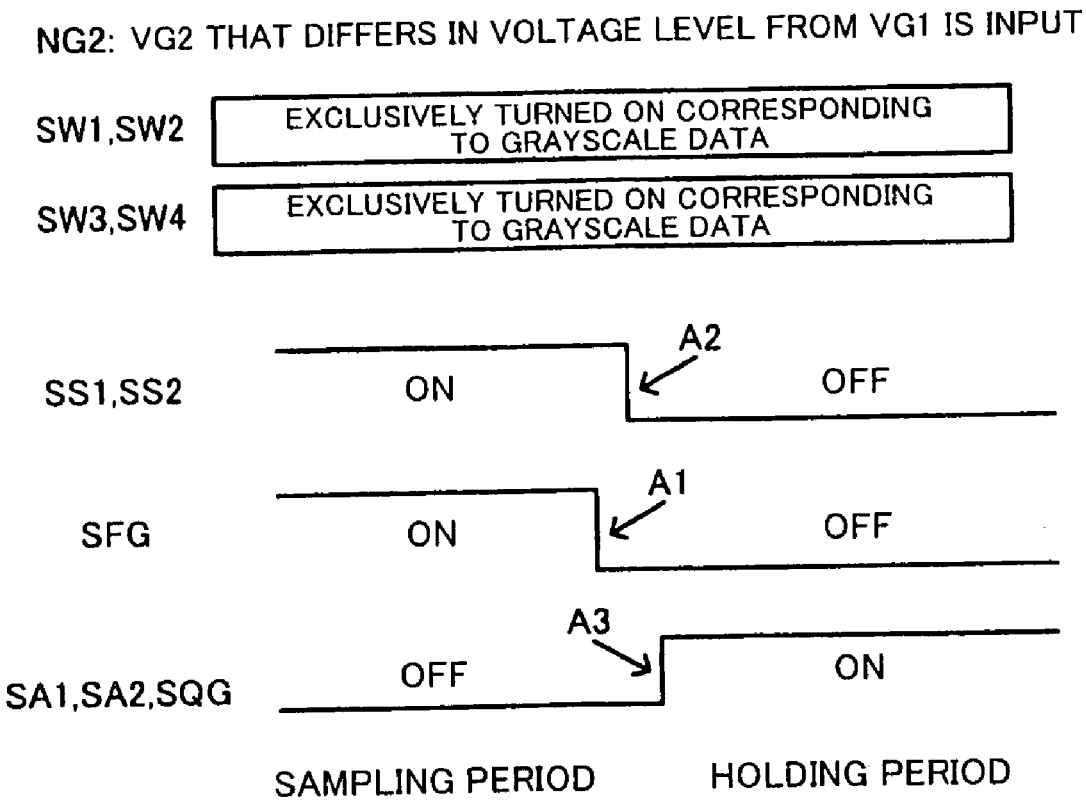
FIG. 12 is a view illustrative of the circuit operation of a grayscale generation amplifier according to one embodiment of the invention.

The sampling switch elements SS1 and SS2 are turned OFF after the feedback switch element SFG has been turned OFF, as indicated by A1 and A2 in FIG. 12. This minimizes an adverse effect of charge injection, as described later. The flip-around switch elements SA1 and SA and the output switch element SQG are turned ON after the sampling switch elements SS1 and SS2 have been turned OFF, as indicated by A3.

Figure 14:
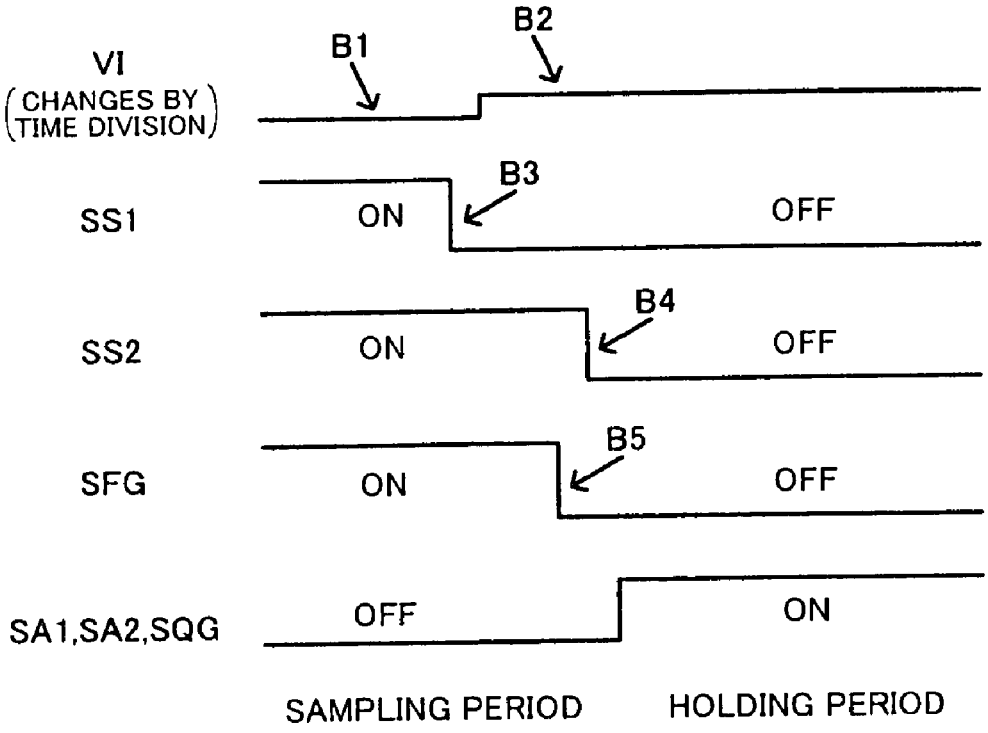
FIG. 14 is a view illustrative of the circuit operation of a grayscale generation amplifier according to a second configuration example.

FIGS. 13A and 13B show a second configuration example of a grayscale generation amplifier, and FIG. 14 is a view illustrative of the circuit operation of the grayscale generation amplifier shown in FIGS. 13A and 13B.

In the second configuration example shown in FIGS. 13A and 13B, the first grayscale voltage and the second grayscale voltage from the D/A conversion circuit 52 are input to the grayscale generation amplifier 62 by time division in the sampling period, as indicated by B1 and B2 in FIG. 14. When the sampling switch element SS1 is turned OFF (B3 in FIG. 14), the first grayscale voltage input and sampled at B1 is held. When the sampling switch element SS2 is turned OFF (B4 in FIG. 14), the second grayscale voltage input and sampled at B2 is held.

In the second configuration example shown in FIGS. 13A to 14, since the sampling period is reduced as compared with FIGS. 11A to 12, a sufficient period of time may not be ensured for the sampling operation so that the accuracy of the output voltage VQG may deteriorate.

According to the configuration shown in FIGS. 11A to 12, since a sufficient sampling period can be provided, an accurate sample-hold operation can be implemented so that an accurate output voltage VQG can be output.

In the second configuration example, since the switch elements SS1 and SS2 must be turned OFF in time series, the switch element SS1 is turned OFF before the switch element SFG is turned OFF, as indicated by B3 and B5 in FIG. 14. Therefore, since the switch element SFG is set in an ON state (i.e., the node NEC is not set in a high impedance state) when the switch element SS1 is turned OFF, an adverse effect of charge injection or clock feedthrough via the switch element SS1 occurs.

According to the configuration shown in FIGS. 11A to 12, since the switches can be controlled at the timings indicated by A1, A2, and A3 in FIG. 12, an adverse effect of charge injection or the like can be minimized so that a variation in the output voltage VQG can be minimized.

Figure 15A:
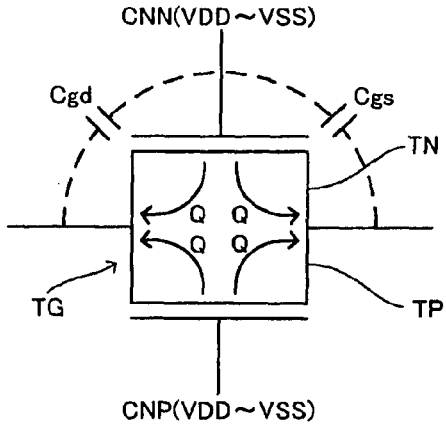
FIG. 15A to 15C are views illustrative of a switch control method according to one embodiment of the invention.

FIG. 15A shows an example of a transfer gate TG used as the switch element. Switch control signals CNN and CNP are respectively input to the gates of an N-type transistor TN and a P-type transistor TP that form the transfer gate TG. When the transfer gate TG is turned OFF, clock feedthrough occurs due to a gate-drain parasitic capacitor Cgd and a gate-source parasitic capacitor Cgs. When the transfer gate TG is turned OFF, a charge in the channel flows into the drain or the source (i.e., charge injection occurs).

Figure 15B:
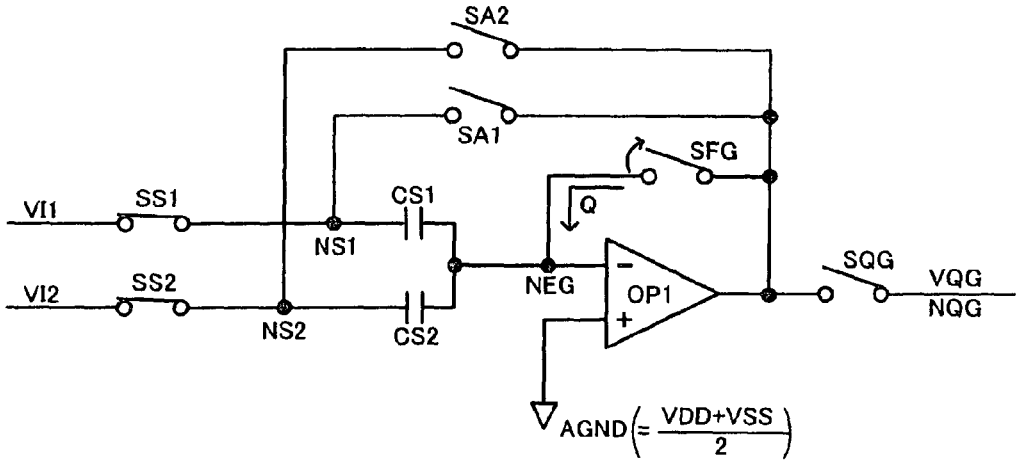
Figure 15C:
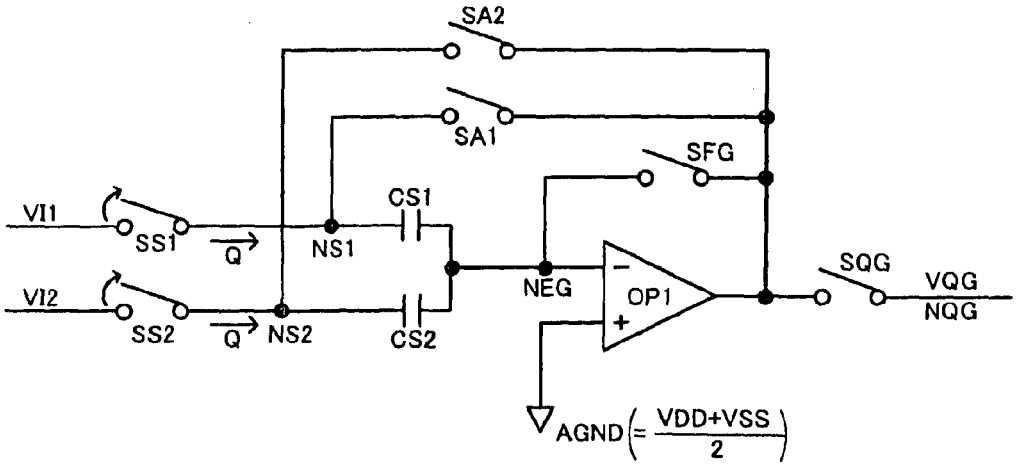

According to this embodiment, since the sampling switch elements SS1 and SS2 are turned OFF (see FIG. 15C) after the feedback switch element SFG has been turned OFF (see FIG. 15B), an adverse effect of charge injection or clock feedthrough can be reduced as compared with the second configuration example shown in FIGS. 13A to 14.

Specifically, if the switch element SFG is turned OFF when the switch elements SS1 and SS2 are set in an ON state (see FIG. 15B), an adverse effect of charge injection or clock feedthrough via the switch element SFG occurs. However, the switch element SFG has been turned OFF (i.e., the node NEG has been set in a high impedance state) when the switch elements SS1 and SS2 are turned OFF (see FIG. 15C). Therefore, an adverse effect of charge injection or clock feedthrough via the switch elements SS1 and SS2 does not occur. As a result, an adverse effect of charge injection or clock feedthrough can be reduced as compared with the second configuration example.

The switch control signals CNN and CNP having an amplitude between VDD and VSS are input to the gates of the transistors TN and TP of the transfer gate TG shown in FIG. 15A. Therefore, when the potential of the drain or the source of the transfer gate TG is set at VSS or VDD, an imbalance occurs between the amount of charge from the N-type transistor TN and the amount of charge from the P-type transistor TP. As a result, a charge due to charge injection remains without being canceled.

According to this embodiment, the non-inverting input terminal of the operational amplifier OP1 is set at the analog reference voltage AGND (i.e., the intermediate voltage between the voltage supplied from the power supply VDD (second power supply in a broad sense) and the voltage supplied from the power supply VSS (first power supply in a broad sense) immediately before the switch element SFG is turned OFF (see FIG. 15B), and the potential of the node NEG is set at the analog reference voltage AGND (=(VDD+VSS)/2) due to the virtual short-circuit function of the operational amplifier OP1. Therefore, since the source and the drain of the switch element SFG are set at the analog reference voltage AGND (i.e., independent of the input grayscale voltage) immediately before the switch element SFG is turned OFF and an imbalance between the amount of charge from the N-type transistor TN and the amount of charge from the P-type transistor TP can be reduced, an adverse effect of charge injection that occurs when the switch element SFG is turned OFF can be minimized.

Figure 16:
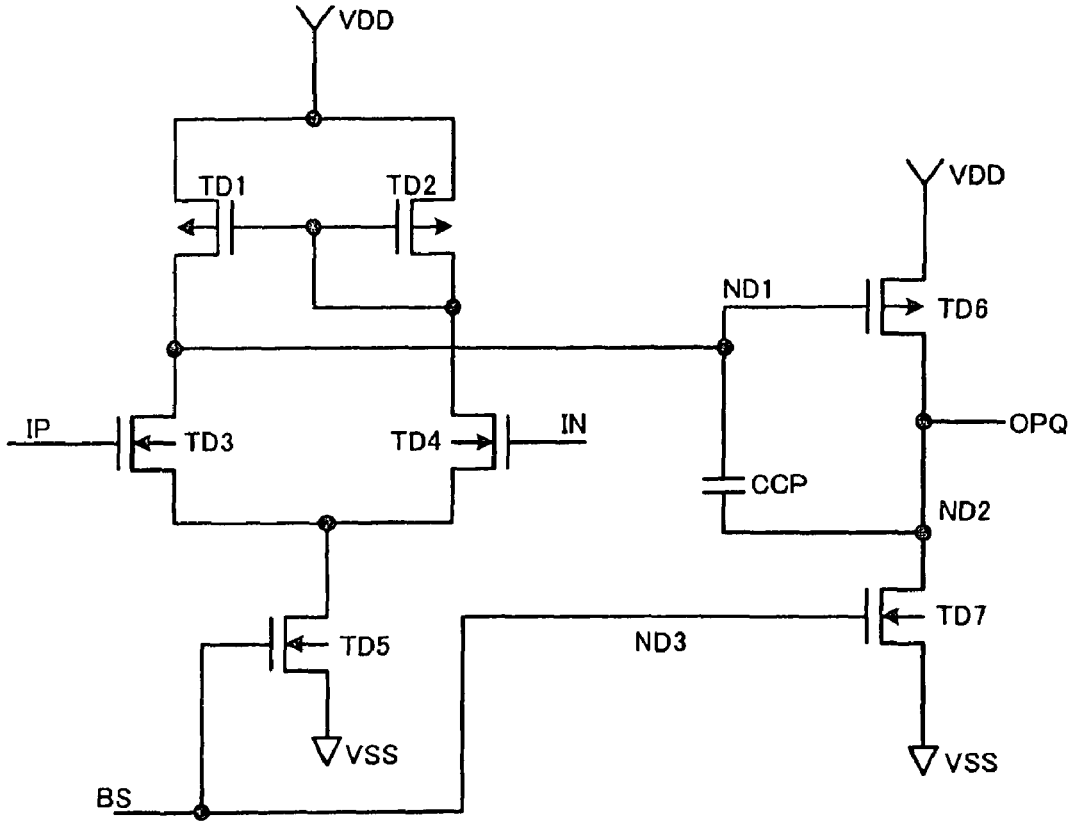
FIG. 16 shows a configuration example of an operational amplifier of a grayscale generation amplifier.

FIG. 16 shows a configuration example of the operational amplifier OP1. The operational amplifier OP1 performs a class A amplification operation. In FIG. 16, a differential section (differential stage) of the operational amplifier OP1 is formed by transistors TD1, TD2, TD3, TD4, and TD5, and an output section (output stage) of the operational amplifier OP1 is formed by transistors TD6 and TD7. In FIG. 16, a phase-compensation capacitor CCP is provided between an output node ND1 of the differential section and an output node ND2 of the operational amplifier OP1.

6. Driver Amplifier

Figure 17:
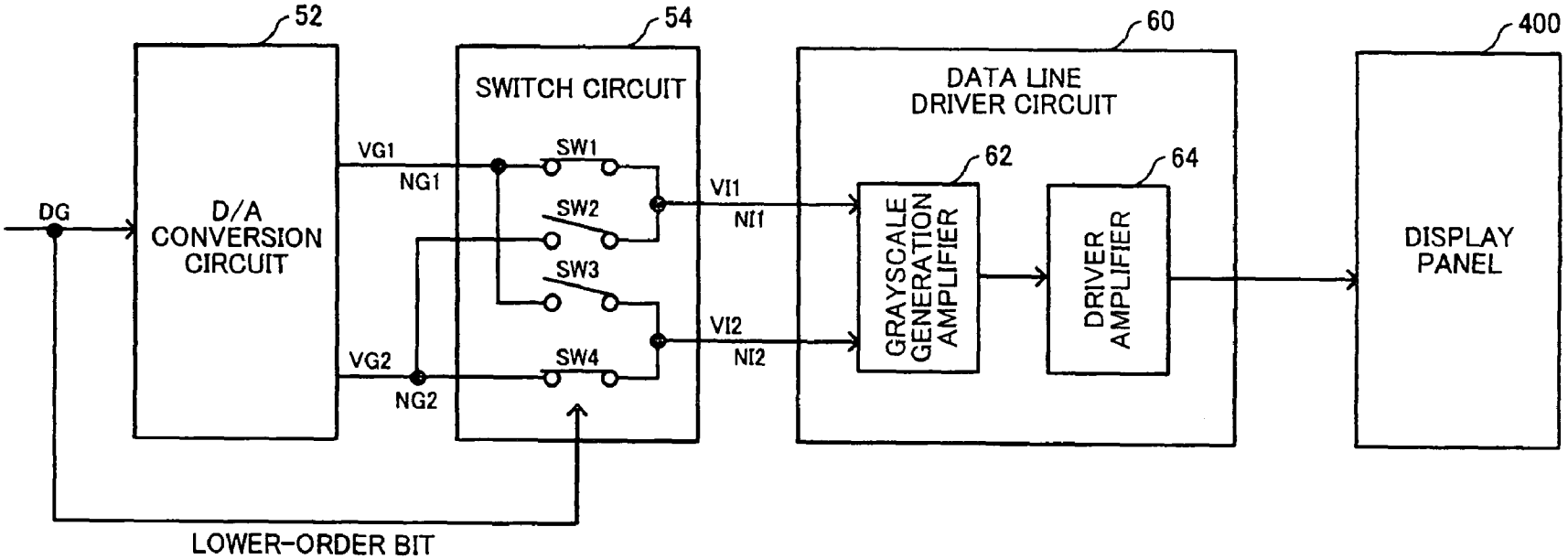
FIG. 17 shows a first modification of a data driver.

FIG. 17 shows a first modification of the data driver. FIG. 17 differs from FIG. 8 in that the data line driver circuit 60 further includes a driver amplifier 64.

The driver amplifier 64 (driver sample-hold circuit or output amplifier) is provided in the subsequent stage of the grayscale generation amplifier 62, and drives the data line of the display panel 400. The driver amplifier 64 may also be formed by the flip-around sample-hold circuit described with reference to FIGS. 10A and 10B. According to this configuration, since a variation in the output voltage of the driver amplifier 64 can be minimized due to the offset cancellation function of the flip-around sample-hold circuit, the display quality can be improved.

Figure 18:
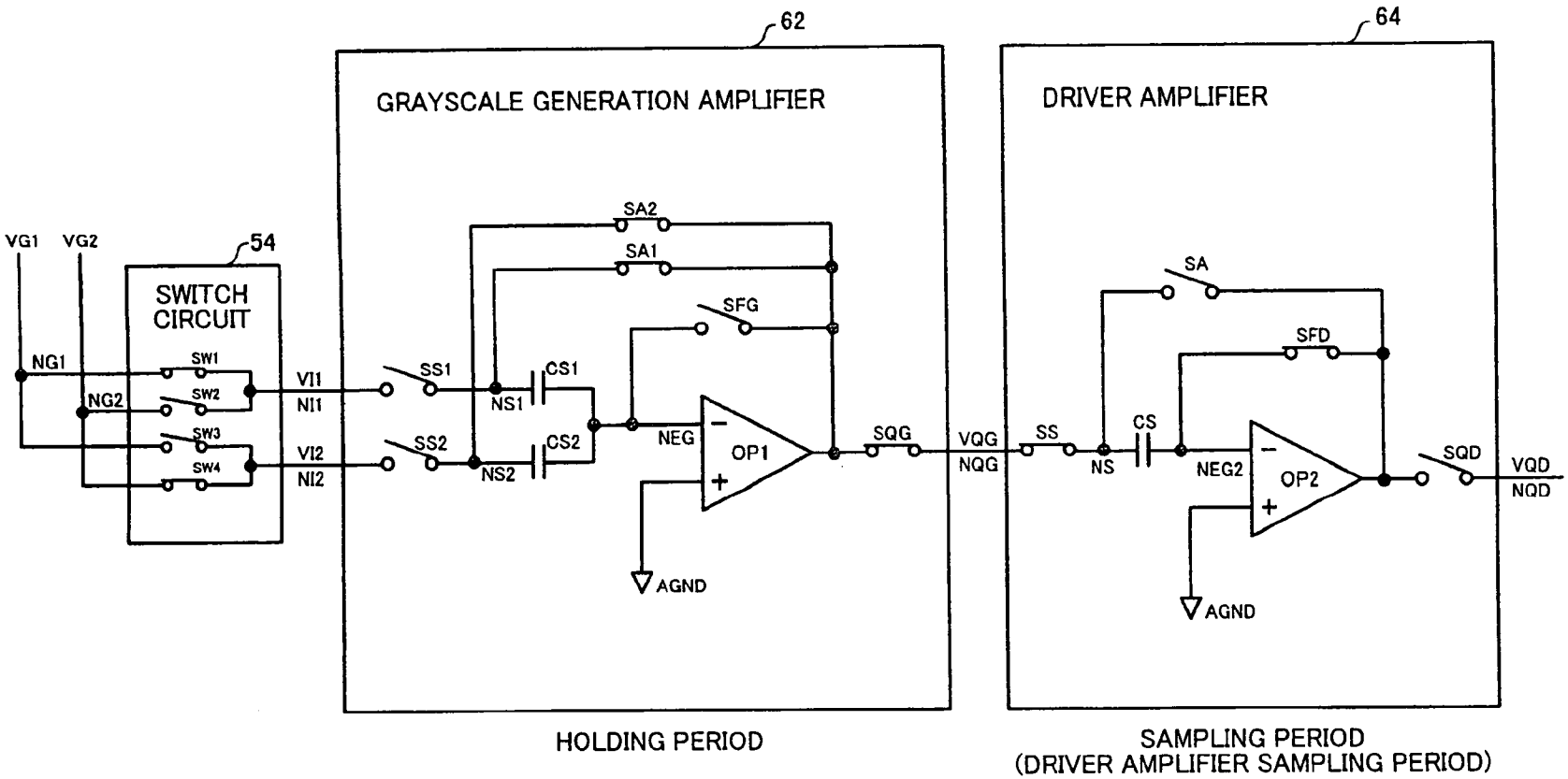
FIG. 18 shows a detailed configuration example of a driver amplifier.
Figure 19:
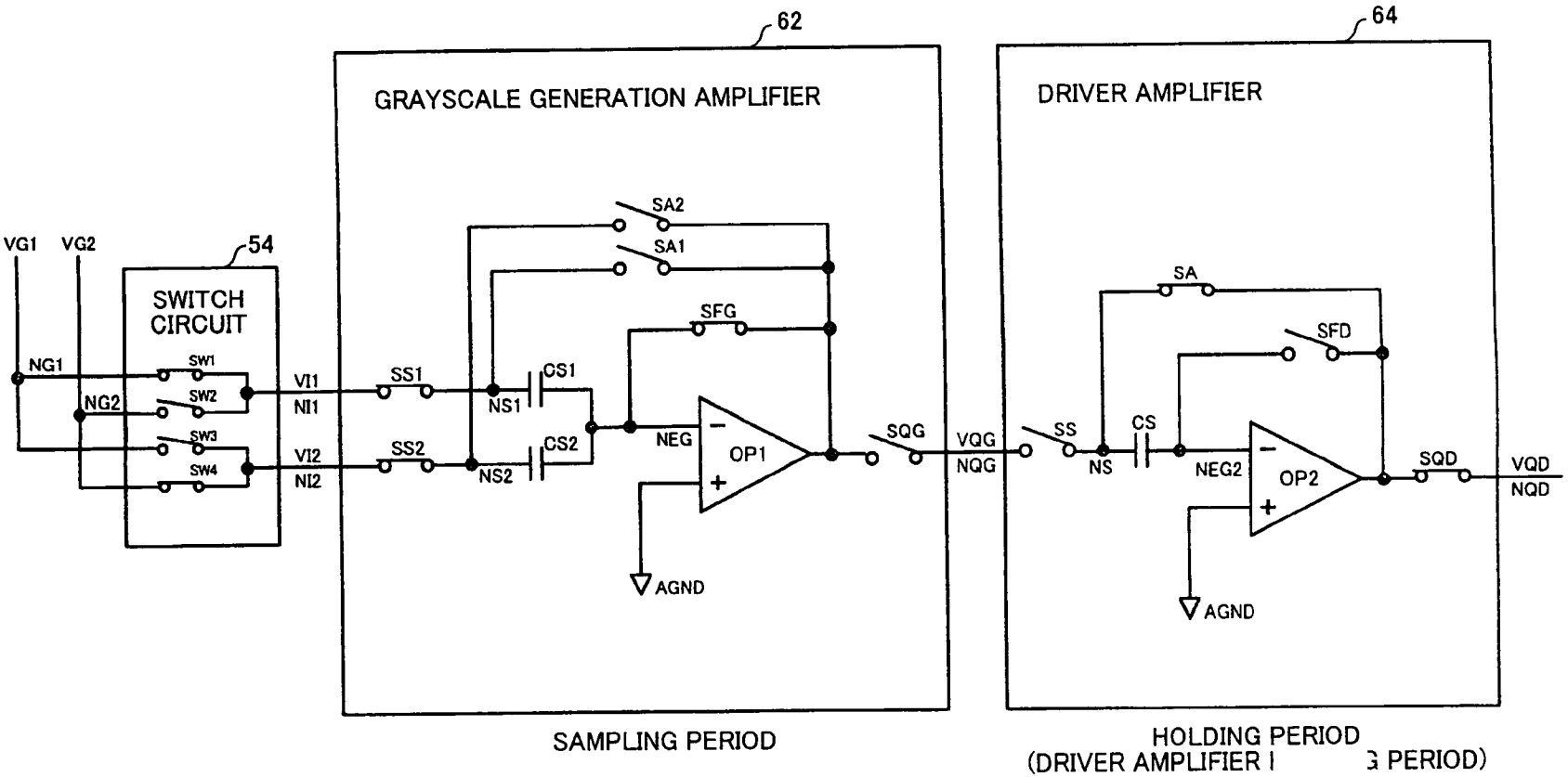
FIG. 19 shows a detailed configuration example of a driver amplifier.

FIGS. 18 and 19 show a specific configuration example of the driver amplifier 64. Note that the configuration of the driver amplifier 64 is not limited to the configuration shown in FIGS. 18 and 19. Various modifications may be made such as omitting some of the elements or adding other elements.

The driver amplifier 64 includes a second operational amplifier OP2 and a sampling capacitor CS. The sampling capacitor CS is provided between an inverting input terminal (first input terminal) of the operational amplifier OP2 and an input node NQG of the driver amplifier 64.

As shown in FIG. 18, a charge corresponding to the input voltage VQG at the input node NQG is stored in the sampling capacitor CS in a driver amplifier sampling period. Specifically, the grayscale generation amplifier 62 performs the holding operation in the driver amplifier sampling period, and outputs the voltage VQG corresponding to a charge stored in the sampling period. The driver amplifier 64 samples the output voltage VQG in the driver amplifier sampling period.

The driver amplifier 64 outputs an output voltage VQD corresponding to a charge stored in the capacitor CS in the driver amplifier sampling period shown in FIG. 18 in a driver amplifier holding period, as shown in FIG. 19. In the driver amplifier holding period, the grayscale generation amplifier 62 performs the sampling operation, and the output switch element SQG has been turned OFF.

The driver amplifier 64 includes the operational amplifier OP2, a sampling switch element SS, the sampling capacitor CS, a second feedback switch element SFD, and a flip-around switch element SA. The driver amplifier 64 also includes an output switch element SQD.

A non-inverting input terminal (second input terminal) of the operational amplifier OP2 is set at the analog reference voltage AGND (given reference voltage).

The sampling switch element SS and the sampling capacitor CS are provided between the input node NQG of the driver amplifier 64 and the inverting input terminal (first input terminal) of the operational amplifier OP2. The feedback switch element SFD is provided between the output terminal and the inverting input terminal of the operational amplifier OP2.

The flip-around switch element SA is provided between a connection node NS situated between the switch element SS and the capacitor CS and the output terminal of the operational amplifier OP2. The output switch element SQD is provided between the output terminal of the operational amplifier OP2 and an output node NQD of the driver amplifier 64.

In the driver amplifier sampling period, the sampling switch element SS and the feedback switch element SFD are turned ON, and the flip-around switch element SA is turned OFF, as shown in FIG. 18. This implements the sampling operation of the flip-around sample-hold circuit.

In the driver amplifier holding period, the sampling switch element SS and the feedback switch element SFD are turned OFF, and the flip-around switch element SA is turned ON, as shown in FIG. 19. This implements the holding operation of the flip-around sample-hold circuit.

In the driver amplifier sampling period, the output switch element SQD is turned OFF, as shown in FIG. 18. This causes the output of the driver amplifier 64 to be set in a high impedance state so that a situation in which an indefinite voltage in the sampling period is transmitted to the subsequent stage can be prevented. In the driver amplifier holding period, the output switch element SQD is turned ON, as shown in FIG. 19. Therefore, the voltage sampled in the sampling period can be output to the subsequent stage.

The voltage VQG output from the grayscale generation amplifier 62 in the holding period can be sampled in the driver amplifier sampling period (see FIG. 18) by providing the above-described driver amplifier 64. The driver amplifier 64 can output the voltage VQD corresponding to the voltage VQG to the data line instead of the grayscale generation amplifier 62 in the sampling period of the grayscale generation amplifier 62 (see FIG. 19).

For example, when the sampling period of the grayscale generation amplifier 62 is increased, since the data line cannot be driven in the sampling period of the grayscale generation amplifier 62 because the output of the grayscale generation amplifier 62 is set in a high impedance state so that a sufficient drive time cannot be ensured.

On the other hand, when providing the driver amplifier 64 shown in FIGS. 18 and 19, the driver amplifier 64 is set in a holding operation mode in the sampling period of the grayscale generation amplifier 62 so that the data line can be driven. This enables the drive time to be increased so that the display quality can be improved.

In particular, when a plurality of data line driver circuits 60 share one D/A conversion circuit 52 and the D/A conversion circuit 52 supplies the grayscale voltages to the data line driver circuits 60 by time division, the total time of the sampling periods of the data line driver circuits 60 increases to a large extent.

On the other hand, when providing the driver amplifier 64 shown in FIGS. 18 and 19, the driver amplifier 64 is set in the holding operation mode in the sampling periods of the data line driver circuits 60 so that the data line can be driven. Therefore, a highly accurate voltage can be supplied to the data line so that the display quality can be improved.

When providing the driver amplifier 64 in addition to the grayscale generation amplifier 62, the operational amplifier OP1 included in the grayscale generation amplifier 62 may be formed by an amplifier that performs a class A amplification operation, and the operational amplifier OP2 included in the driver amplifier 64 may be formed by an amplifier that performs a class AB amplification operation, for example. Specifically, the operational amplifier OP2 is formed by an amplifier that performs a class A amplification operation in the sampling period and performs a class AB amplification operation in the holding period.

For example, the operational amplifier OP1 shown in FIG. 16 that forms the grayscale generation amplifier 62 is an amplifier that performs a class A amplification operation. The circuit can be simplified and power consumption can be easily reduced by utilizing the amplifier that performs a class A amplification operation. When providing the driver amplifier 64 in the subsequent stage of the grayscale generation amplifier 62, since the drive load of the grayscale generation amplifier 62 consists only of the sampling capacitor CS and the like of the driver amplifier 64 (i.e., the drive load is low), the driver amplifier 64 can be driven normally.

On the other hand, since the driver amplifier 64 must drive the data line having a large parasitic capacitance in the holding period, the drive load of the driver amplifier 64 is high. Therefore, the operational amplifier OP2 of the driver amplifier 64 is formed by an amplifier that can perform a class AB amplification operation.

Figure 20:
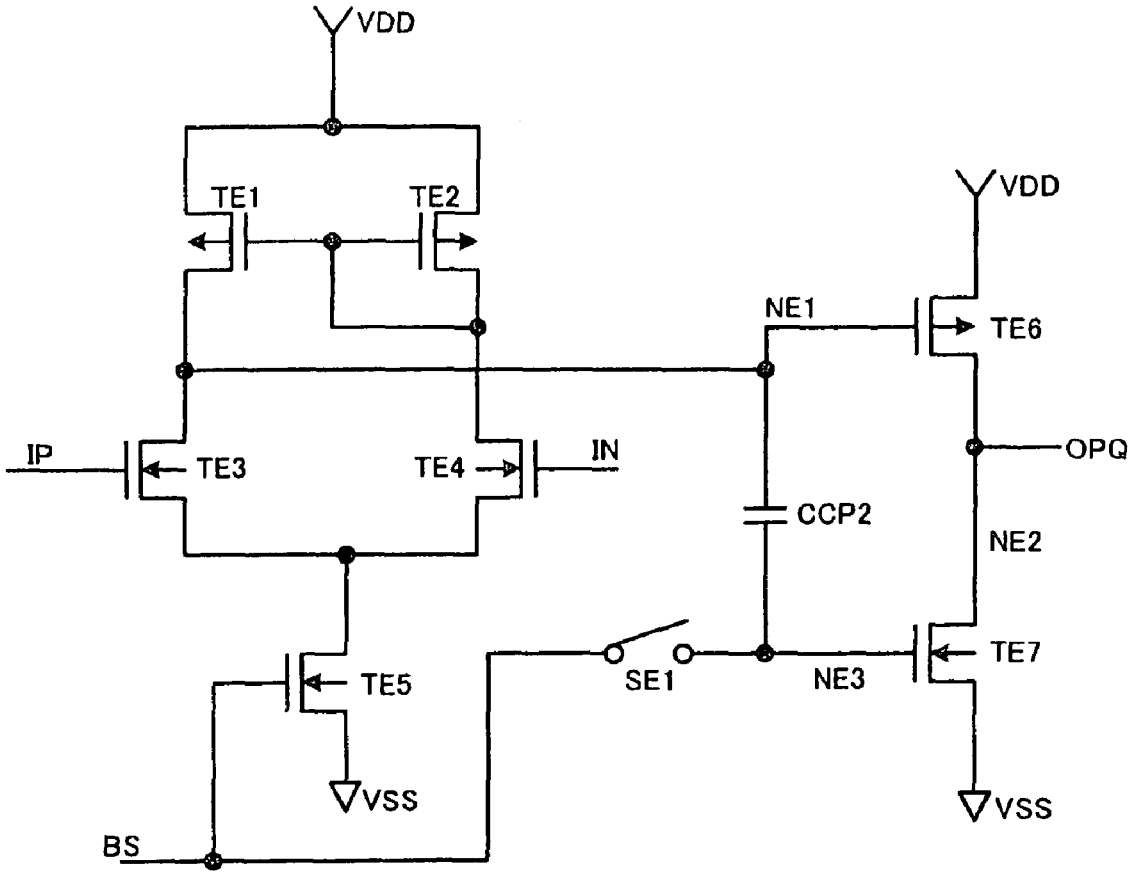
FIG. 20 shows a configuration example of an operational amplifier of a driver amplifier.

FIG. 20 shows a configuration example of the operational amplifier OP2 that can perform a class AB amplification operation. The operational amplifier OP2 includes a differential section (differential stage) formed by transistors TE1, TE2, TE3, TE4, and TE5, and an output section (output stage) formed by transistors TE6 and TE7.

The operational amplifier OP2 shown in FIG. 20 differs from the operational amplifier OP1 shown in FIG. 16 in that a switch element SE1 is provided. A bias voltage BS is supplied to one end of the switch element SE1, and the other end of the switch element SE1 is connected to a gate node NE3 of the transistor TE7 of the output section. A capacitor CCP2 is provided between an output node NE1 of the differential section and the gate node NE3 of the transistor TE7.

The switch element SE1 is turned ON in the driver amplifier sampling period. Therefore, the bias voltage BS is input to the gate of the transistor TE7 of the output section so that the operational amplifier OP2 shown in FIG. 20 functions as an amplifier that performs a class A amplification operation. The switch element SE1 is turned OFF in the driver amplifier holding period. Therefore, the gate node NE3 of the transistor TE7 is set in a floating state so that the voltage of a node NE2 changes corresponding to a change in the voltage of the node NE1 due to the capacitor CCP2. As a result, the operational amplifier OP2 shown in FIG. 20 functions as an amplifier that performs a class AB amplification operation.

7. Number of Switch Elements

Figure 21:
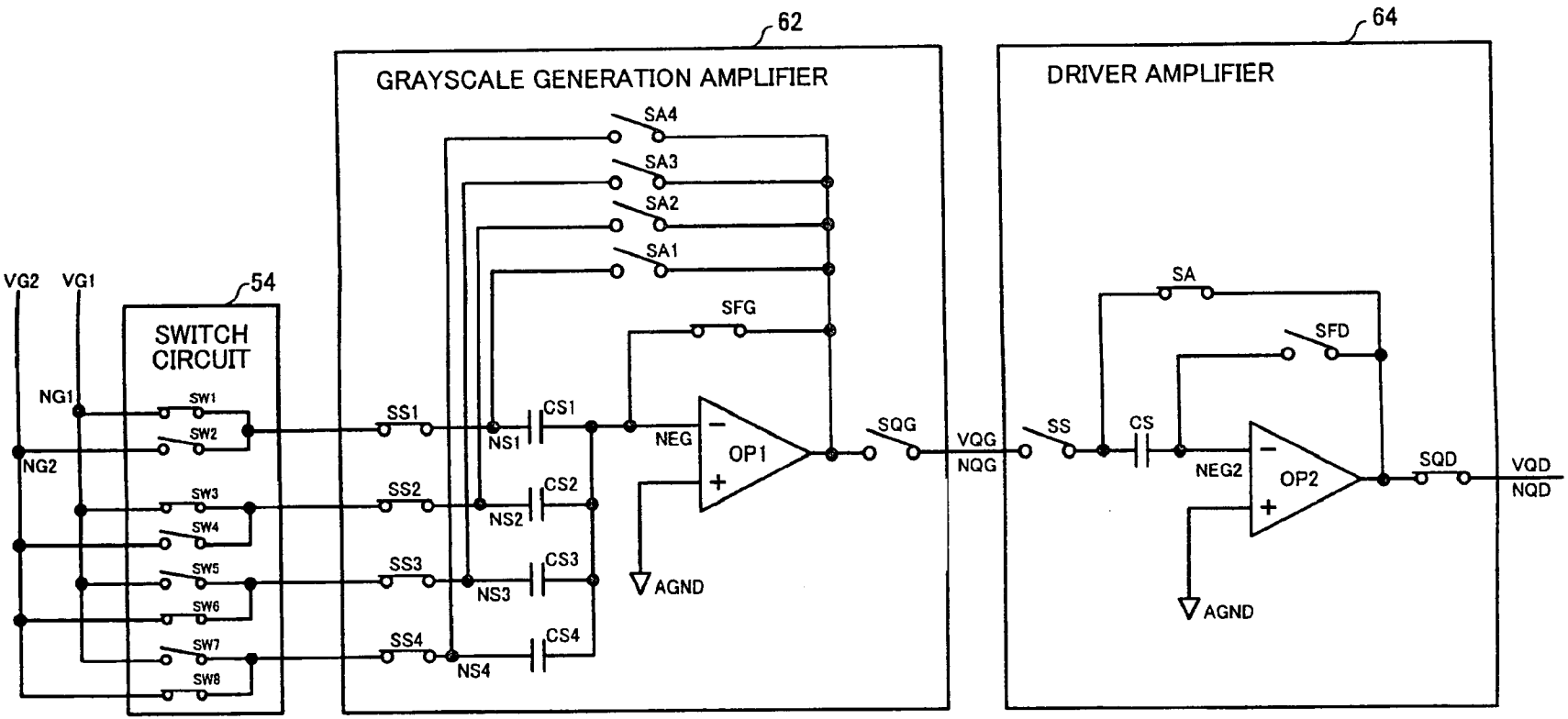
FIG. 21 shows a second modification of a data driver.

FIG. 21 shows a second modification of the data driver. In FIG. 18, the four switch elements SW1 to SW4 are provided in the switch circuit 54. Note that this embodiment is not limited thereto. For example, eight switch elements SW1 to SW8 are provided in the switch circuit 54 shown in FIG. 21. Note that the number of switch elements may be larger than eight (e.g., sixteen or thirty-two).

In FIG. 18, the grayscale generation amplifier 62 includes the two sampling switch elements SS1 and SS2, the two sampling capacitors CS1 and CS2, and the two flip-around switch elements SA1 and SA. Note that the numbers of these elements are not limited two. In FIG. 21, the grayscale generation amplifier 62 includes four sampling switch elements SS1 to SS4, four sampling capacitors CS1 to CS4, and four flip-around switch elements SA1 to SA4, for example. Note that the numbers of these elements may be larger than four (e.g., eight or sixteen).

In FIG. 21, the switch elements SW1 and SW2, the switch elements SW3 and SW4, the switch elements SW5 and SW6, and the switch elements SW7 and SW8 are exclusively turned ON/OFF, respectively. The grayscale generation amplifier 62 is caused to generate a grayscale voltage between the first grayscale voltage VG1 and the second grayscale voltage VG2 in the same manner as in FIG. 9 by causing the switch elements SW1 to SW8 to be turned ON/OFF. In FIG. 9, one grayscale voltage between the first grayscale voltage VG1 and the second grayscale voltage VG2 is generated. In FIG. 21, three grayscale voltages between the first grayscale voltage VG1 and the second grayscale voltage VG2 can be generated.

For example, when the number of bits of grayscale data is eight (i.e., the number of grayscales is $2^8$ (=256)), it suffices that the grayscale voltage generation circuit 10 generate 128 grayscale voltages when using the configuration shown in FIG. 18. Therefore, it suffices that the D/A conversion circuit 52 include selectors that select voltages from the 128 grayscale voltages.

According to the configuration shown in FIG. 21, it suffices that the grayscale voltage generation circuit 110 generate 64 grayscale voltages. Therefore, it suffices that the D/A conversion circuit 52 include selectors that select voltages from the 64 grayscale voltages. Accordingly, the circuit scale of the grayscale voltage generation circuit 110 and the D/A conversion circuit 52 and the number of grayscale voltage lines can be further reduced so that the area of the integrated circuit device including the data driver can be further reduced.

8. Connection Configuration of D/A Conversion Circuit and Switch Circuit

Figure 22:
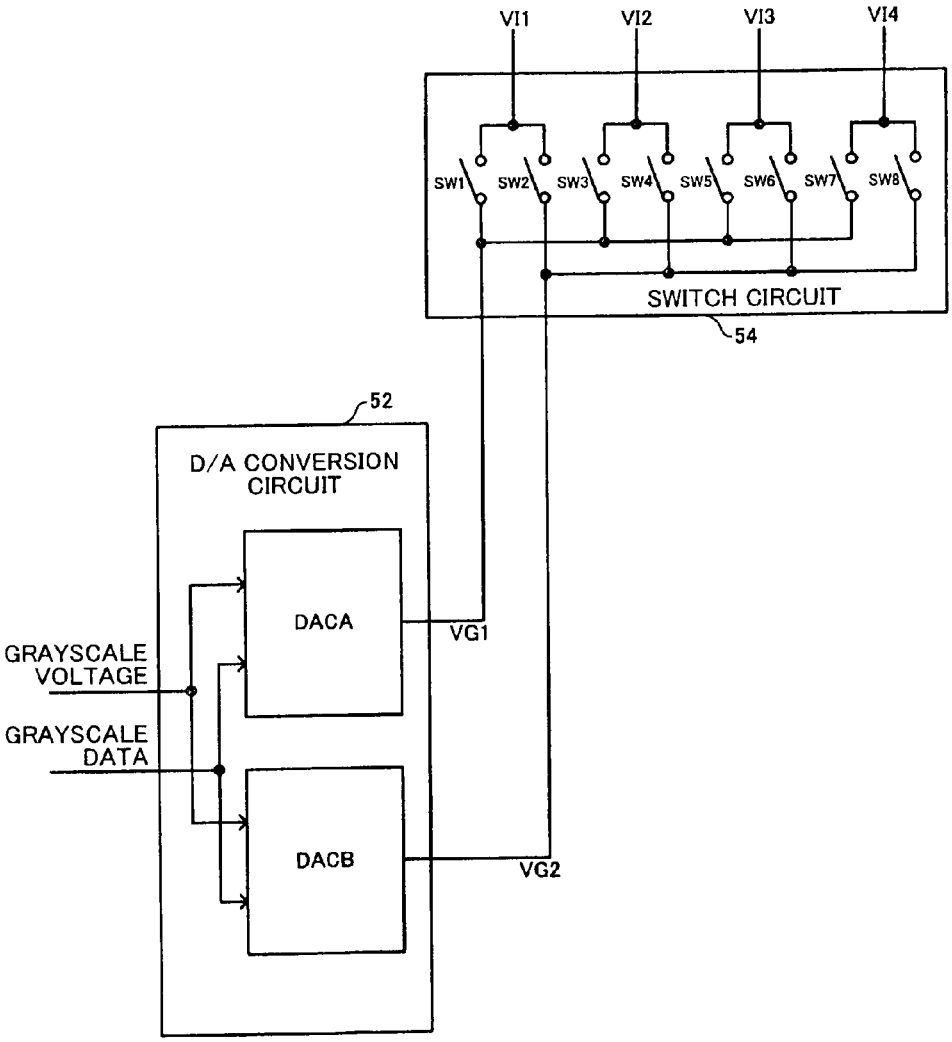
FIG. 22 shows a connection configuration example of a D/A conversion circuit and a switch circuit.

FIG. 22 shows a connection configuration example of the D/A conversion circuit 52 and the switch circuit 54 that includes eight switch elements SW1 to SW8. As shown in FIG. 22, the first grayscale voltage VG1 from the first D/A converter DACA is input to one end of the switch elements SW1, SW3, SW5, and SW7, and the second grayscale voltage VG2 from the second D/A converter DACB is input to one end of the switch elements SW2, SW4, SW6, and SW8. The voltage VI1 is output to the other end of the switch elements SW1 and SW2, and the voltage VI2 is output to the other end of the switch elements SW3 and SW4. The voltage VI3 is output to the other end of the switch elements SW5 and SW6, and the voltage VI4 is output to the other end of the switch elements SW7 and SW8.

FIG. 23 is a view showing the relationship among the grayscale data, the ON/OFF states of the switch elements SW1 to SW8, and the input voltages VI1 to VI4 of the grayscale generation amplifier 62.

In FIG. 23, when the second bit D2 (jth bit in a broad sense, j is a natural number) of the grayscale data is "0" (first logic level in a broad sense), the first grayscale voltage VG1 is higher than the second grayscale voltage VG2. When the second bit D2 is "1" (second logic level in a broad sense), the second grayscale voltage VG2 is higher than the first grayscale voltage VG1.

For example, when the bits D7 to D2 of the grayscale data are (000000) (i.e., the bit D2 is "0"), the first grayscale voltage VG1 is V and the second grayscale voltage VG2 is 0 (VG1>VG2), as shown in FIG. 5. When the bits D7 to D2 of the grayscale data are (000001) (i.e., the bit D2 is "1"), the first grayscale voltage VG1 is V and the second grayscale voltage VG2 is 2V (VG1<VG2).

Specifically, since the first D/A converter DACA and the second D/A converter DACB according to this embodiment have the configuration shown in FIG. 4 or the like, the relationship between the first grayscale voltage VG1 and the second grayscale voltage VG2 output from the first D/A converter DACA and the second D/A converter DACB changes corresponding to the logic level of the bit D2 (bit D1 when employing the configuration shown in FIG. 2).

In FIG. 23, when the relationship between the first grayscale voltage VG1 and the second grayscale voltage VG2 changes corresponding to the logic level of the bit D2, the switch elements SW1 to SW8 (first to fourth switch elements) are ON/OFF-controlled so that the output voltage (sampling voltage) of the grayscale generation amplifier 62 monotonically increases (or monotonically decreases) as the data formed by the lower-order bits (D1 and D0) of the bit P2 (jth bit) increases.

In FIG. 23, when the bits D2 to D0 are (000), for example, since the switch elements SW2, SW4, SW6, and SW8 are turned ON and the switch elements SW1, SW3, SW5, and SW7 are turned OFF, the voltage input to the grayscale generation amplifier 62 is VI1=VI2=VI3=VI4=VG2. As shown in FIG. 24, when the first grayscale voltage VG1 is 0.2 V and the second grayscale voltage VG2 is 0.0 V, for example, the output voltage (sampling voltage) (i.e., the average voltage of the voltages VI1 to VI4) of the grayscale generation amplifier 62 is VS=VG2=0.0 V.

When the bits D2 to D0 are (001), since the switch element SW1 is turned ON and the switch element SW2 is turned OFF, VI1=VG1 and VI2=VI3=VI4=VG2, as shown in FIG. 23. Therefore, the output voltage of the grayscale generation amplifier 62 is VS=(VG1+VG2+VG2+VG2)/4=0.2/4=0.05 V, as shown in FIG. 24.

When the bits D2 to D0 are (010), VI1=VI2=VG1 and VI3=VI4=VG2, as shown in FIG. 23. Therefore, the output voltage of the grayscale generation amplifier 62 is VS=(VG1+VG1+VG2+VG2)/4=0.4/4=0.10 V, as shown in FIG. 24. Likewise, when the bits D2 to D0 are (011), since VI1=VI2=VI3=VG1 and V14=VG2, VS=0.15 V.

As described above, when the bit D2 is "0" and VG1>VG2 is satisfied, the output voltage VS of the grayscale generation amplifier 62 increases monotonically by performing ON/OFF-control shown in FIG. 23.

When the bits D2 to D0 are (100), VI1=VI2=VI3=VI4=VG1, as shown in FIG. 23. Therefore, the output voltage VS of the grayscale generation amplifier 62 is 0.20 V, as shown in FIG. 24. When the bits D2 to D0 are (101), since VI1=VG2 and VI2=VI3=VI4=VG1, the output voltage VS of the grayscale generation amplifier 62 is 0.25 V. Likewise, when the bits D2 to D0 are (110), the output voltage VS of the grayscale generation amplifier 62 is 0.30 V. When the bits D2 to D0 are (111), the output voltage VS of the grayscale generation amplifier 62 is 0.35 V.

As described above, the output voltage VS of the grayscale generation amplifier 62 increases monotonically (or decreases monotonically) by performing ON/OFF-control shown in FIG. 23 even when the bit D2 has changed from "0" to "1" and the relationship between the first grayscale voltage VG1 and the second grayscale voltage VG2 has changed from "VG1>VG2" to "VG1<VG2". Therefore, an appropriate voltage corresponding to the grayscale data can be output.

9. Electronic Instrument

Figure 25A:
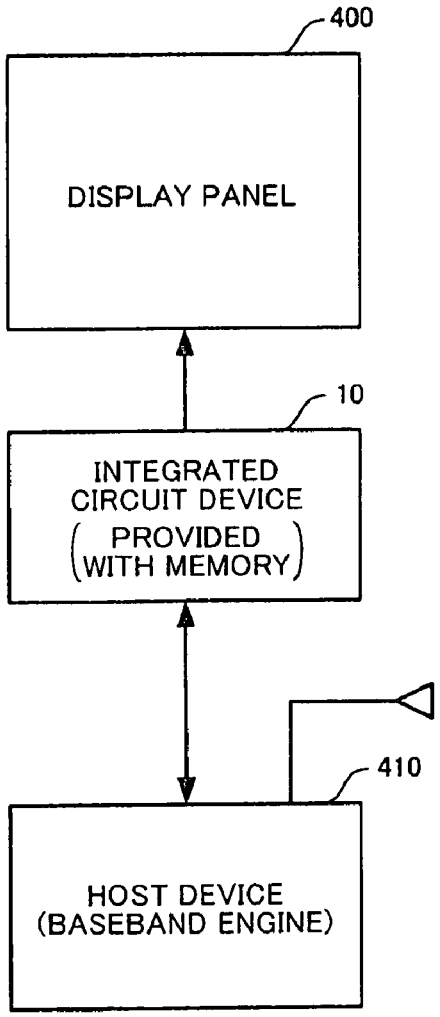
FIGS. 25A and 25B show configuration examples of an electronic instrument.
Figure 25B:
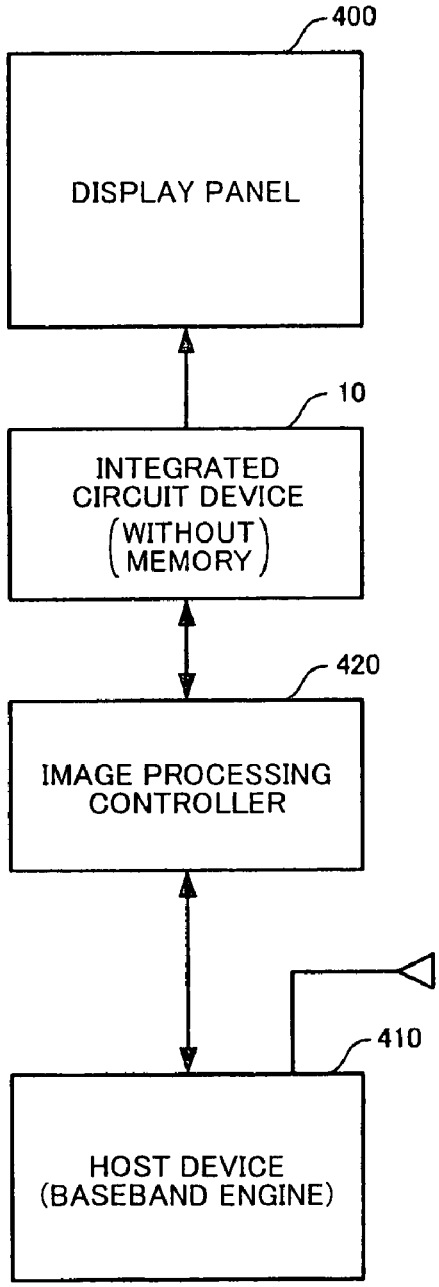

FIGS. 25A and 25B show configuration examples of an electronic instrument (electro-optical device) including the integrated circuit device 10 according to the above embodiment. Note that various modifications may be made such as omitting some of the elements shown in FIGS. 25A and 25B or adding other elements (e.g., camera, operation section, or power supply). The electronic instrument according to this embodiment is not limited to a portable telephone, but may be a digital camera, a PDA, an electronic notebook, an electronic dictionary, a projector, a rear-projection television, a portable information terminal, or the like.

In FIGS. 25A and 25B, a host device 410 is an MPU, a baseband engine, or the like. The host device 410 controls the integrated circuit device 10 (i.e., display driver). The host device 410 may also perform a process of an application engine or a baseband engine, or a process (e.g., compression, decompression, or sizing) of a graphic engine. An image processing controller 420 shown in FIG. 25B performs a process (e.g., compression, decompression, or sizing) of a graphic engine instead of the host device 410.

In FIG. 25A, the integrated circuit device 10 may include a memory. In this case, the integrated circuit device 10 writes image data from the host device 410 into the built-in memory, reads the image data from the built-in memory, and drives the display panel. In FIG. 25B, the integrated circuit device 10 may not include a memory. In this case, image data output from the host device 410 is written into a built-in memory of the image processing controller 420. The integrated circuit device 10 drives the display panel 400 under control of the image processing controller 420.

Although some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g., grayscale voltage, grayscale data, display panel, inverting input terminal, non-inverting input terminal, AGND, VSS, and VDD) cited with a different term (e.g., input voltage, input data, electro-optical device, first input terminal, second input terminal, reference voltage, first power supply, and second power supply) having a broader meaning or the same meaning at least once in the specification and the drawings can be replaced by the different term in any place in the specification and the drawings. The configurations and the operations of the data driver, the D/A conversion circuit, the first D/A converter, the second D/A converter, the data driver, the switch circuit, the data line driver circuit, the grayscale generation amplifier, the driver amplifier, the integrated circuit device, the electronic instrument, and the like are not limited to those described with reference to the above embodiments. Various modifications and variations may be made.

What is claimed is:

1. A D/A conversion circuit comprising:

a first D/A converter that selects a voltage corresponding to input data from a plurality of input voltages and outputs the selected voltage as a first voltage; and a second D/A converter that selects a voltage corresponding to the input data from a plurality of input voltages and outputs the selected voltage as a second voltage, each of the first D/A converter and the second D/A converter including multiple-stage selector blocks, an output from a selector included in a preceding-stage selector block among the multiple-stage selector blocks being input to a selector included in a subsequent-stage selector block among the multiple-stage selector blocks;

a first-stage selector block included in the multiple-stage selector blocks of the first D/A converter including a plurality of two-input selectors;

a first-stage selector block included in the multiple-stage selector blocks of the second D/A converter including a plurality of three-input selectors;

an ith two-input selector (i is an integer equal to or larger than zero) among the plurality of two-input selectors of the first D/A converter selecting a (4i+1)th input voltage or a (4i+3)th input voltage among the plurality of input voltages based on the input data, and outputting the selected input voltage to the selector of the selector block in the subsequent stage; and an ith three-input selector among the plurality of three-input selectors of the second D/A converter selecting a 4ith input voltage, a (4i+2)th input voltage, or a (4i+4)th input voltage among the plurality of input voltages based on the input data, and outputting the selected input voltage to the selector of the selector block in the subsequent stage.

2. The D/A conversion circuit as defined in claim 1, selectors included in the second-stage or subsequent-stage selector blocks of the first D/A converter and selectors included in the second-stage or subsequent-stage selector blocks of the second D/A converter being controlled based on common selector control signals.

3. The D/A conversion circuit as defined in claim 1, the ith two-input selector selecting and outputting the (4i+1)th input voltage or the (4i+3)th input voltage based on a (j+1)th bit (j is a natural number) of the input data; and the ith three-input selector selecting and outputting the 4ith input voltage, the (4i+2)th input voltage, or the (4i+4)th input voltage based on the (j+1)th bit and a jth bit of the input data.

4. The D/A conversion circuit as defined in claim 1, the input data being grayscale data; and the first voltage and the second voltage being a first grayscale voltage and a second grayscale voltage corresponding to the grayscale data, respectively.

5. A data driver that drives a data line of an electro-optical device, the data driver comprising:

the D/A conversion circuit as defined in claim 4 that receives the grayscale data and outputs the first grayscale voltage and the second grayscale voltage corresponding to the grayscale data; and a data line driver circuit that includes a grayscale generation amplifier that generates a grayscale voltage between the first grayscale voltage and the second grayscale voltage.

6. The data driver as defined in claim 5, the grayscale generation amplifier being formed by a flip-around sample-hold circuit.

7. The data driver as defined in claim 6, the grayscale generation amplifier including:

an operational amplifier;

a first sampling capacitor that is provided between a first input terminal of the operational amplifier and a first input node of the grayscale generation amplifier and stores a charge corresponding to an input voltage at the first input node in a sampling period; and a second sampling capacitor that is provided between the first input terminal of the operational amplifier and a second input node of the grayscale generation amplifier and stores a charge corresponding to an input voltage at the second input node in the sampling period, the grayscale generation amplifier outputting an output voltage in a holding period, the output voltage corresponding to charges stored in the first sampling capacitor and the second sampling capacitor in the sampling period.

8. The data driver as defined in claim 6, the grayscale generation amplifier including:

an operational amplifier, a second input terminal of the operational amplifier being set at a given reference voltage;

a first sampling switch element and a first sampling capacitor, the first sampling switch element and the first sampling capacitor being provided between a first input node of the grayscale generation amplifier and a first input terminal of the operational amplifier;

a second sampling switch element and a second sampling capacitor, the second sampling switch element and the second sampling capacitor being provided between a second input node of the grayscale generation amplifier and the first input terminal of the operational amplifier;

a feedback switch element provided between an output terminal of the operational amplifier and the first input terminal of the operational amplifier;

a first flip-around switch element provided between a first connection node and the output terminal of the operational amplifier, the first connection node being situated between the first sampling switch element and the first sampling capacitor; and a second flip-around switch element provided between a second connection node and the output terminal of the operational amplifier, the second connection node being situated between the second sampling switch element and the second sampling capacitor.

9. The data driver as defined in claim 8, the first sampling switch element, the second sampling switch element, and the feedback switch element being turned ON and the first flip-around switch element and the second flip-around switch element being turned OFF in a sampling period; and the first sampling switch element, the second sampling switch element, and the feedback switch element being turned OFF and the first flip-around switch element and the second flip-around switch element being turned ON in a holding period.

10. The data driver as defined in claim 9, the grayscale generation amplifier including an output switch element provided between the output terminal of the operational amplifier and an output node of the grayscale generation amplifier;

the output switch element being turned OFF in the sampling period; and the output switch element being turned ON in the holding period.

11. The data driver as defined in claim 9, the first sampling switch element and the second sampling switch element being turned OFF after the feedback switch element has been turned OFF.

12. The data driver as defined in claim 5, the data line driver circuit including a driver amplifier provided in the subsequent stage of the grayscale generation amplifier.

13. The data driver as defined in claim 12, the driver amplifier being formed by a flip-around sample-hold circuit.

14. The data driver as defined in claim 5, further comprising:

a switch circuit that is provided between the D/A conversion circuit and the data line driver circuit, the switch circuit including:

a first switch element provided between a first voltage output node of the D/A conversion circuit and a first input node of the grayscale generation amplifier, the first voltage output node being an output node of the first grayscale voltage;

a second switch element that is provided between a second voltage output node of the D/A conversion circuit and the first input node of the grayscale generation amplifier and is exclusively turned ON/OFF with respect to the first switch element, the second voltage output node being an output node of the second grayscale voltage;

a third switch element provided between the first voltage output node of the D/A conversion circuit and a second input node of the grayscale generation amplifier; and a fourth switch element that is provided between the second voltage output node of the D/A conversion circuit and the second input node of the grayscale generation amplifier and is exclusively turned ON/OFF with respect to the third switch element.

15. The data driver as defined in claim 14, the first grayscale voltage being higher than the second grayscale voltage when a jth bit (j is a natural number) of the grayscale data is set at a first logic level, and the second grayscale voltage being higher than the first grayscale voltage when the jth bit of the grayscale data is set at a second logic level, the first switch element, the second switch element, the third switch element, and the fourth switch element being turned ON/OFF so that the output voltage of the grayscale generation amplifier increases monotonically or decreases monotonically as data formed by lower-order bit of the jth bit increases.

16. An integrated circuit device comprising the data driver as defined in claim 5.

17. An electronic instrument comprising the integrated circuit device as defined in claim 16.

* * * * *